US011090541B2

(12) United States Patent
Moran

(10) Patent No.: US 11,090,541 B2
(45) Date of Patent: Aug. 17, 2021

(54) MARTIAL ARTS TRAINING APPARATUS

(71) Applicant: Robert J. Moran, Belmont, MA (US)

(72) Inventor: Robert J. Moran, Belmont, MA (US)

( * ) Notice: Subject to any disclaimer, the term of this patent is extended or adjusted under 35 U.S.C. 154(b) by 146 days.

(21) Appl. No.: 16/509,213

(22) Filed: Jul. 11, 2019

(65) Prior Publication Data

US 2019/0329111 A1 Oct. 31, 2019

Related U.S. Application Data

(63) Continuation-in-part of application No. 15/297,231, filed on Oct. 19, 2016, now Pat. No. 10,384,109.

(60) Provisional application No. 62/243,445, filed on Oct. 19, 2015.

(51) Int. Cl.
*A63B 69/00* (2006.01)
*A63B 71/06* (2006.01)

(52) U.S. Cl.
CPC ..... *A63B 69/004* (2013.01); *A63B 71/0622* (2013.01); *A63B 2069/0042* (2013.01); *A63B 2071/0625* (2013.01); *A63B 2225/74* (2020.08)

(58) Field of Classification Search
CPC ..... A63B 69/004; A63B 2069/0042
USPC ..... 273/398, 401–404, 408
See application file for complete search history.

(56) References Cited

U.S. PATENT DOCUMENTS 3,601,353 A 8/1971 Dale
4,171,803 A 10/1979 Smith
4,173,336 A 11/1979 Perry
4,201,379 A 5/1980 Williams
4,361,330 A 11/1982 Scharer
4,732,378 A * 3/1988 LeFebvre ..... A63B 69/004 482/88
4,757,990 A 7/1988 Dosch
4,776,584 A * 10/1988 Tilley ..... A63B 69/004 294/131
5,145,133 A 9/1992 France
5,201,527 A * 4/1993 Koket ..... A63B 71/0036 273/402
5,254,062 A 10/1993 Hoffman
5,362,289 A 11/1994 Holt
6,019,375 A 2/2000 West, Jr.
6,896,642 B1 5/2005 Brown
7,434,810 B2 * 10/2008 DeMille ..... A63F 9/0204 273/404
7,935,034 B2 5/2011 Oh
7,942,791 B1 5/2011 Yocum
(Continued)

FOREIGN PATENT DOCUMENTS

KR 20080001125 U 5/2008

*Primary Examiner* — Nyca T Nguyen
(74) *Attorney, Agent, or Firm* — Glen E. Schumann; Moss & Barnett

(57) ABSTRACT

The present invention is a martial arts training apparatus that includes a first mat having an opening, a second mat having an opening and a pair of handles pivotally mounted to opposite sides of the first mat. At the base of the handles are lateral extensions used to secure the first and second mats together in mating relation to secure a target between the first and second mat openings. In an unlocked position, the handles extend laterally from the sides of the first mat. In a locked position, the handles are pivoted to a position substantially perpendicular to a front side of the first mat. The handle extensions engage a back side of the second mat to lock the first and second mats together.

12 Claims, 31 Drawing Sheets

(56) References Cited

U.S. PATENT DOCUMENTS

| | | | |
|---|---|---|---|
| 8,029,422 | B2 | 10/2011 | Strong |
| 8,556,268 | B2 | 10/2013 | Su |
| 2014/0165270 | A1 | 6/2014 | Gaynor |
| 2015/0273307 | A1 | 10/2015 | Karimi |

* cited by examiner

MARTIAL ARTS TRAINING APPARATUS

CROSS REFERENCE TO RELATED APPLICATION

This application is a continuation in part of U.S. application Ser. No. 15/297,231, which was filed on Oct. 19, 2016, and this application claims priority to U.S. Provisional Application 62/243,445 filed on Oct. 19, 2015, which is hereby incorporated by reference in its entirety.

FIELD OF INVENTION

The present invention relates to a practice target for use in martial arts training.

BACKGROUND OF THE INVENTION

There are several styles of martial arts in which punching and striking techniques are prevalent. Students who practice these forms of martial arts must repeatedly punch and strike targets to acquire the necessary accuracy and skills to excel at martial arts.

Various tools exists for training martial arts students. For instance, a focus mitt may be worn by an instructor and provide a relatively safe, large padded surface for the student to punch and kick without requiring precise accuracy. See also U.S. Pat. No. 8,029,422 to Strong et al. which discloses a suspended blanket used as a kicking target in martial arts and U.S. Pat. No. 5,254,062 to Hoffman which discloses a hanging rigid sheet used as a target in Karate.

Re-breakable boards provide a target with resistance for students to practice punching and striking. A benefit of re-breakable boards is that they are reusable and therefore cost-effective. However, if a student strikes a re-breakable board inaccurately, the blow could result in injury to the student. In addition, time is involved to re-assemble the boards for the next student. See U.S. Pat. No. 4,173,336 to Perry, a practice "breakable" karate board and U.S. Pat. No. 4,171,803 to Smith, a pair of clamps to hold a martial arts target board in place and U.S. Pat. No. 7,942,791 to Yocum, spring loaded, connected boards which are used for a target in martial arts.

U.S. Pat. No. 4,201,379 to Williams discloses a vertically oriented cylindrical practice bag with horizontal cylindrical openings extending through the bag. Fake arms and legs are extended through the horizontal cylindrical openings to simulate an opponent's arms and legs.

U.S. Pat. No. 4,757,990 to Dosch discloses a device for rigidly holding paper which is used as a kick or hand target. However, the threaded rods and frame of the holder present a safety issue should the martial arts participant miss the intended target.

U.S. Pat. No. 3,601,353 to Dale discloses another version of the Dosch invention. The Dale invention holds a paper target to be kicked between two parallel support bars. Again, safety may be a concern.

Targets are also used in other fields. For instance, U.S. Pat. No. 8,556,268 to Su discloses a multi-layer target with a backboard having an opening, a target paper over the opening and a solid disk placed in front of the paper target. When the disk is struck by a bullet, the disk knocks the paper target through the opening in the backboard.

U.S. Pat. No. 6,019,375 to West, Jr. discloses a shooting target that includes layers with reflective and light capturing material to enhance target sighting.

U.S. Pat. No. 5,145,133 to France discloses a foldable target holder for target shooting. A target board has an opening over which a target is placed so that bullets pass through the opening.

There remains a need for an easy to use, safe, re-usable and cost effective target for use in martial arts training classes. The target must withstand striking, while at the same time embody the necessary flexibility should a student miss the target while punching and striking, and require little reassembly.

SUMMARY OF INVENTION

The martial arts training apparatus of the present invention is an easy to use, safe, re-usable and cost effective martial arts target. The target includes, in one preferred embodiment, two square foam mats hinged together so that that a first mat folds on top of a second mat. Each mat has an opening, generally centered in the mat, so that the openings of each mat align when the mats are in the folded position. A paper material is placed between the first and second foam mats so that in the folded position, the openings in the mats are obstructed.

The covered holes in the mats serve as a target for the martial arts student. In use, the folded mats are held by an instructor and a student aims and punches at the covered opening of the mats with a first or foot. If the target is properly struck, the student's first or foot will strike the paper and cause it to break. If the student misses the paper and hits the foam target, the student will not suffer an injury. Lighting or sound mechanisms can be added to the mats so that if the student properly strikes the paper within the mat openings, sound or light can be manually triggered by the instructor or automatically triggered by a sound or light mechanism attached to the mats to indicate an accurate punch or kick.

Lighting or sound mechanisms can be added to the mats so that if the student properly strikes the paper within the mat openings, sound or light can be manually triggered by the instructor or automatically triggered by a sound or light mechanism attached to the mats to indicate an accurate punch or kick (such as the proximity sensor 440).

In one preferred embodiment, the mats are made from high-quality, multi-density foam core. An outside punching surface of each mat is covered by a smooth, non-slip vinyl. The inside surface of each mat is covered with an anti-skid, low density foam to securely engage the paper. A scroll of paper of any desired color, texture or strength may be attached to the mats for continuous scrolling of paper between the openings in the folded mats to quickly generate new targets for students.

BRIEF DESCRIPTION OF THE DRAWINGS

Referring now to the drawings, wherein like reference numerals indicate corresponding structure through the several views.

DETAILED DESCRIPTION OF THE INVENTION

For a thorough understanding of the present disclosure, refer to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

Figure 1:
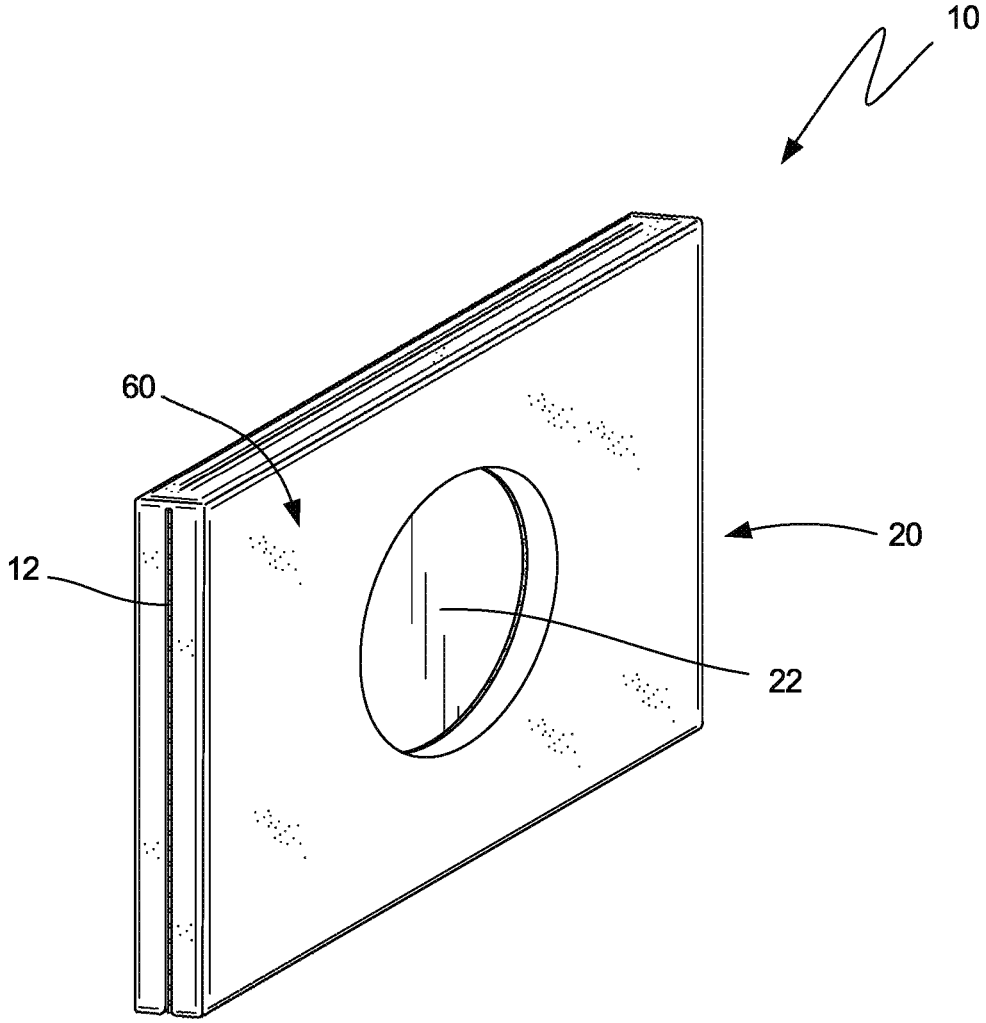
FIG. 1 is a perspective view of one preferred embodiment of the martial arts training apparatus of the present invention with a target paper loaded in the apparatus.
Figure 2:
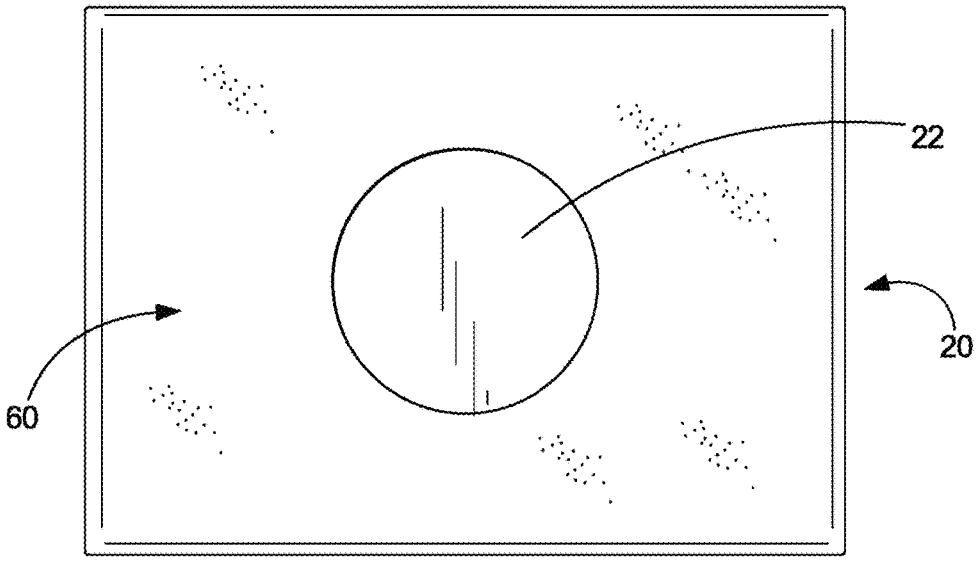
FIG. 2 is a front view of the martial arts training apparatus of the present invention.
Figure 2A:
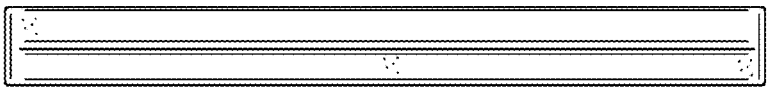
FIG. 2A is a top hinge view of the martial arts training apparatus of the present invention in its closed position.
Figure 2B:
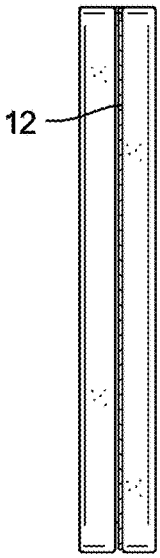
FIG. 2B is a side view of the martial arts training apparatus of the present invention in its closed position.
Figure 2C:
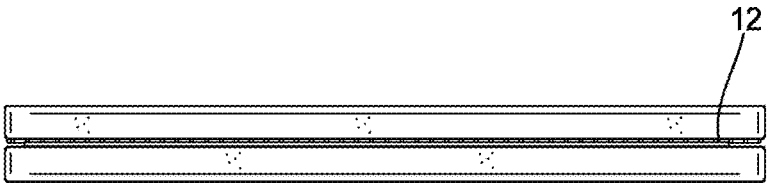
FIG. 2C is a bottom view of the martial arts training apparatus of the present invention in its closed position.

The martial arts training apparatus of the present invention 10, as shown in FIG. 1, is an easy to use, safe, re-usable and cost effective martial arts target tool for use in martial arts training classes.

In a first preferred embodiment, the martial arts training apparatus 10 includes a first mat 20 shown as having a generally square configuration hinged to a second mat 30 by hinge 12. The hinge mechanism can be a "piano" style hinge secured to the mats by screws or any other known hinge and attachment means. Alternatively the first mat 20 and second mat 30 can be integrally formed to fold along a formed hinge 12. The mats are hinged or formed together so that a first mat 20 folds over the second mat 30 like a book.

Figure 3:
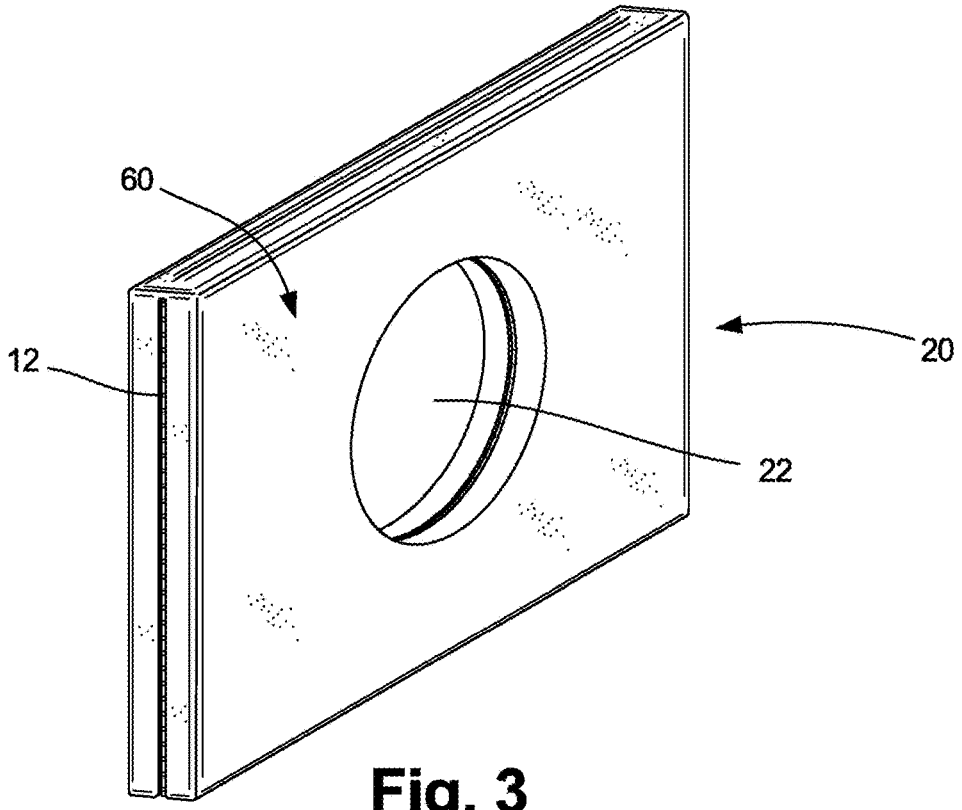
FIG. 3 is a perspective view of one preferred embodiment of the martial arts training apparatus of the present invention without a target paper loaded in the apparatus.

Mat 20 defines an opening 22 and mat 30 defines an opening 32 (see FIG. 3), each opening generally centered in the mats. The openings 22 and 32 align when the mats are in a folded (closed book) position.

Figure 3A:
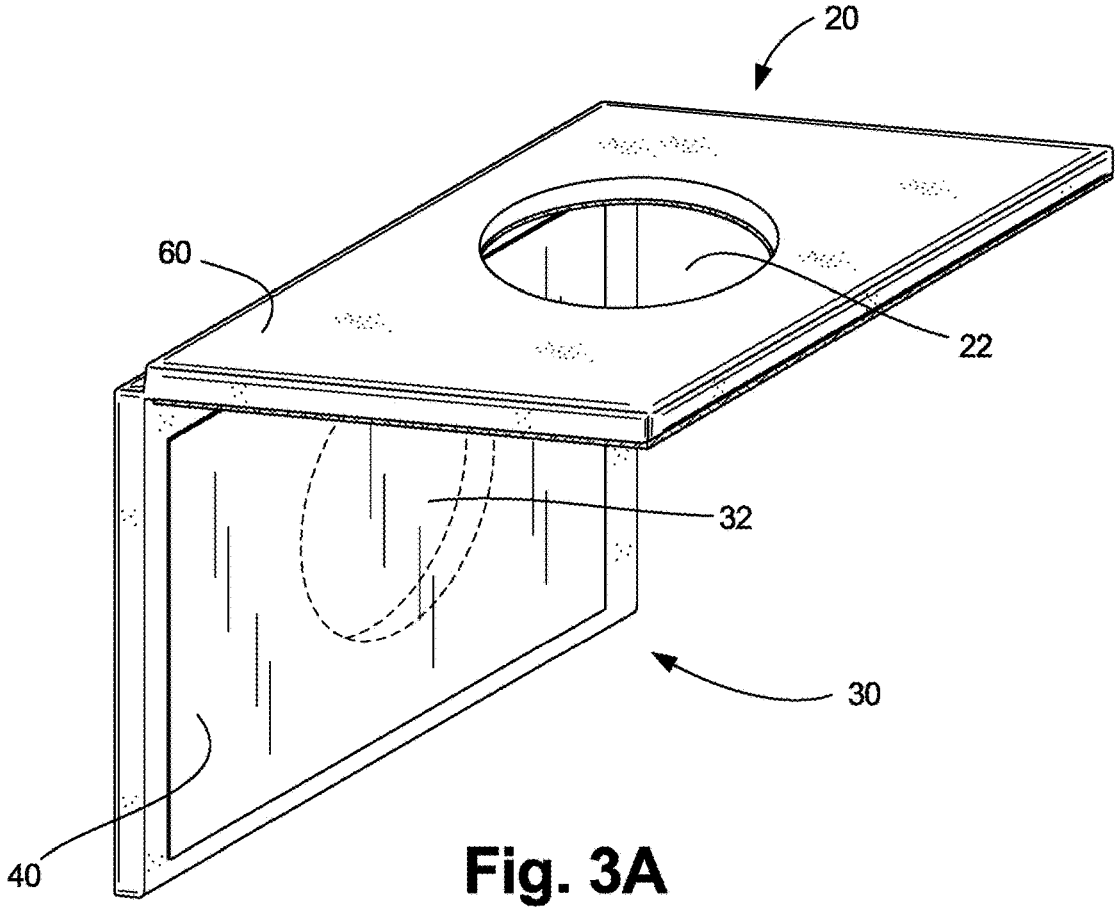
FIG. 3A is perspective view of one preferred embodiment of the martial arts training apparatus of the present invention with paper inserted over one opening of one mat of the training device.
Figure 4:
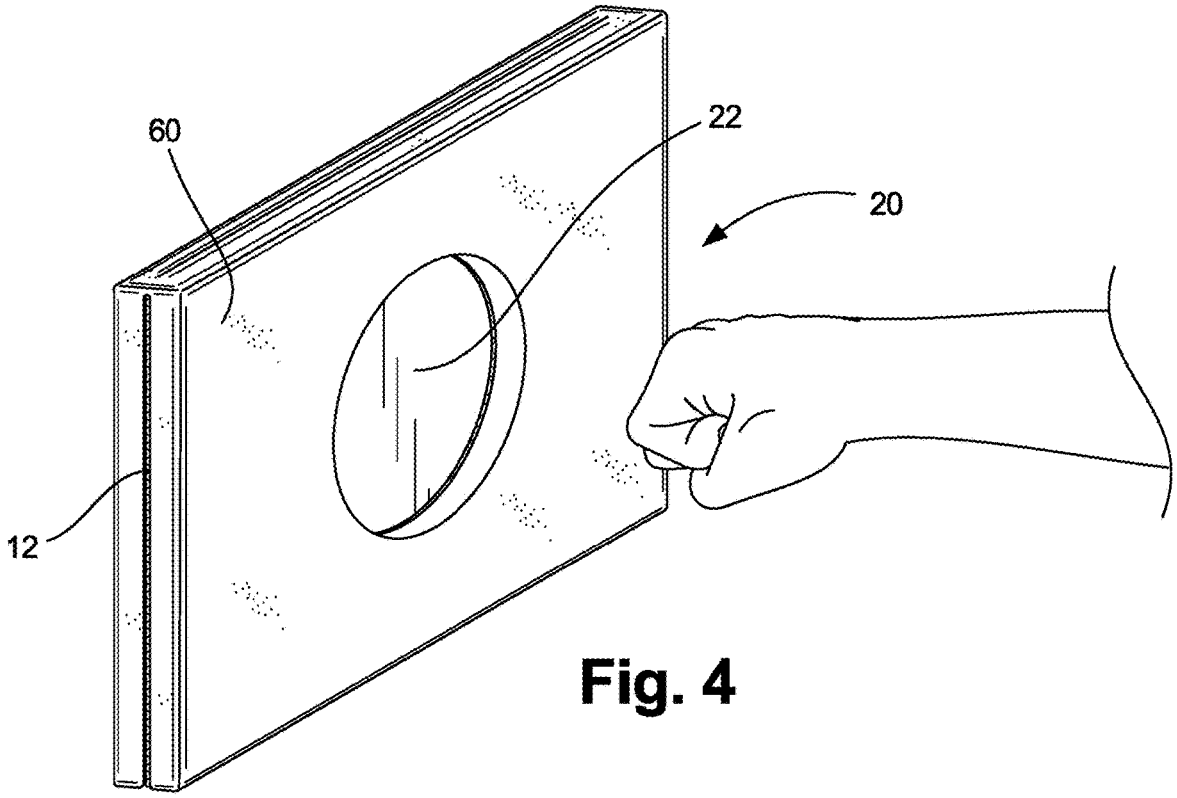
FIG. 4 is a perspective view of one preferred embodiment of the martial arts training apparatus of the present invention in a closed position with a student first about to strike the target.
Figure 4A:
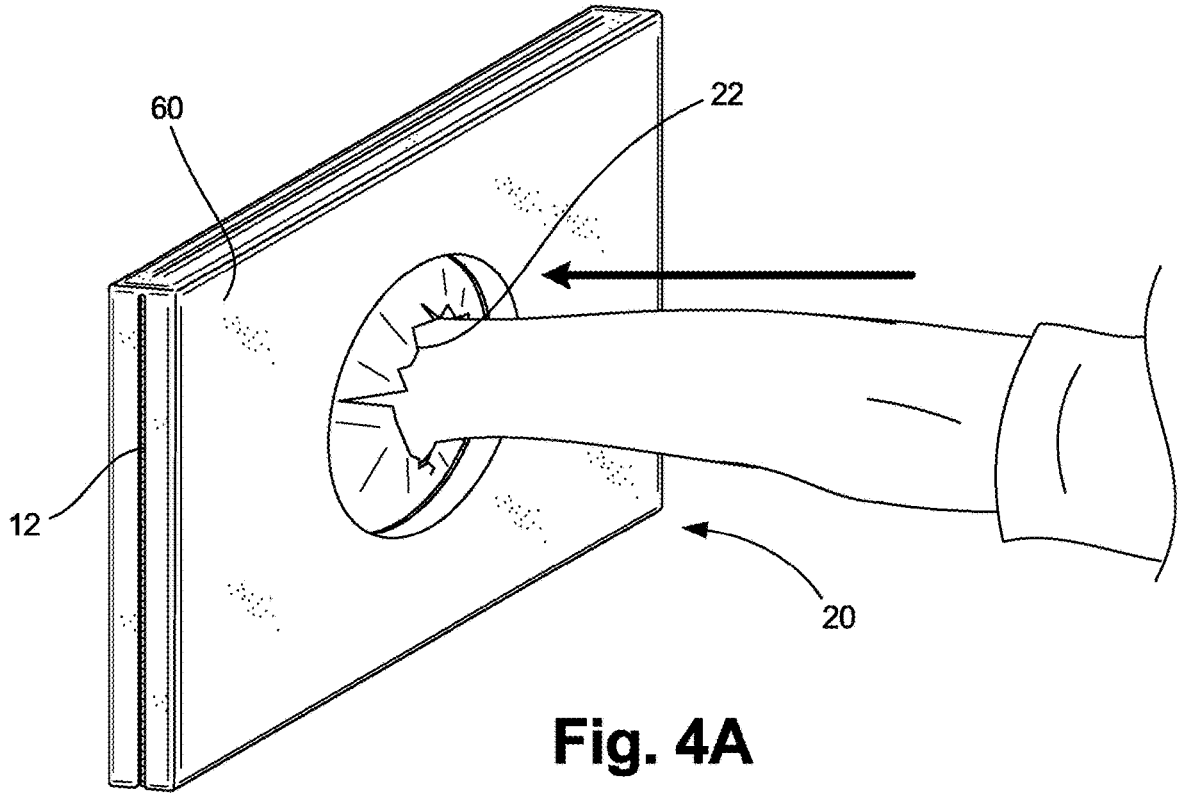
FIG. 4A is a perspective view of one preferred embodiment of the martial arts training apparatus of the present invention in a closed position with a student first striking the target.
Figure 5:
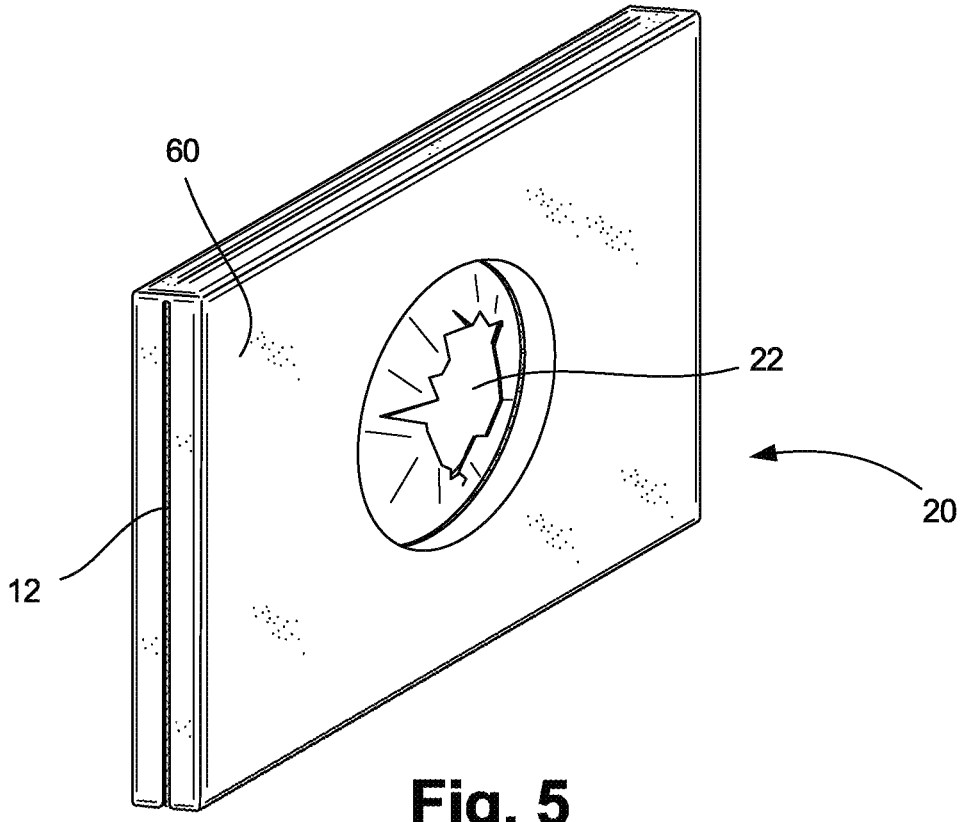
FIG. 5 is a perspective view of one preferred embodiment of the martial arts training apparatus of the present invention in a closed position illustrating a broken target.
Figure 6:
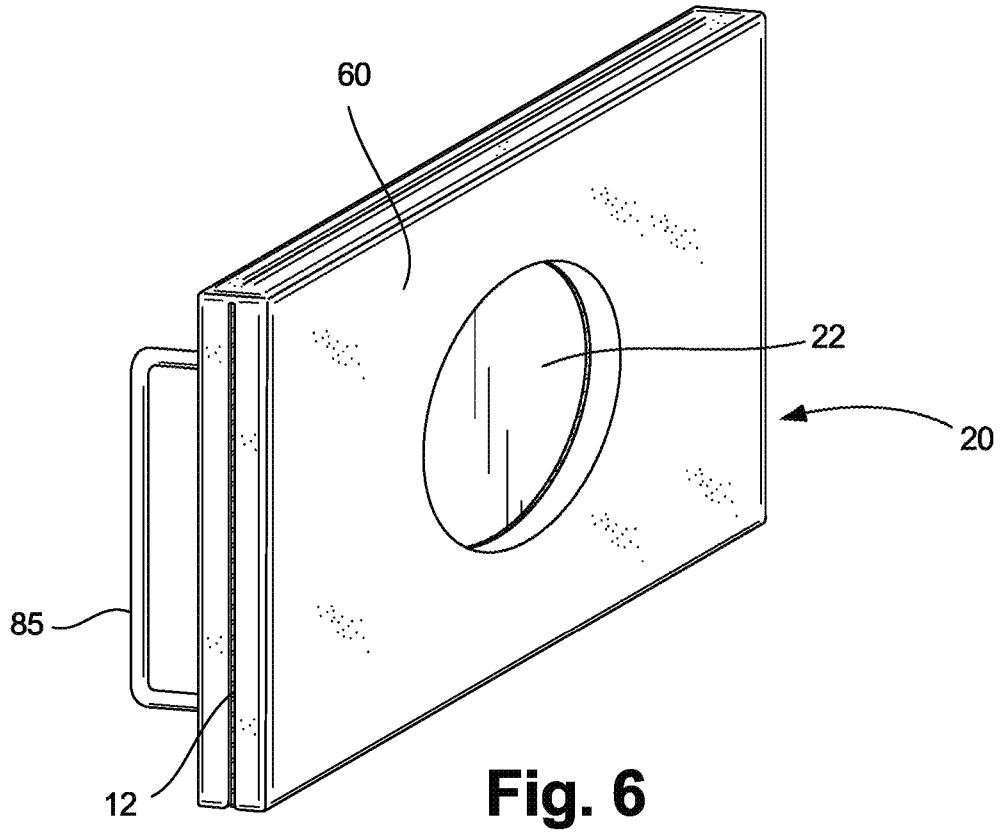
FIG. 6 is a front perspective view of one preferred embodiment of the martial arts training apparatus of the present invention with a target paper loaded in the apparatus and handles mounted on the back for holding or gripping the apparatus.
Figure 6A:
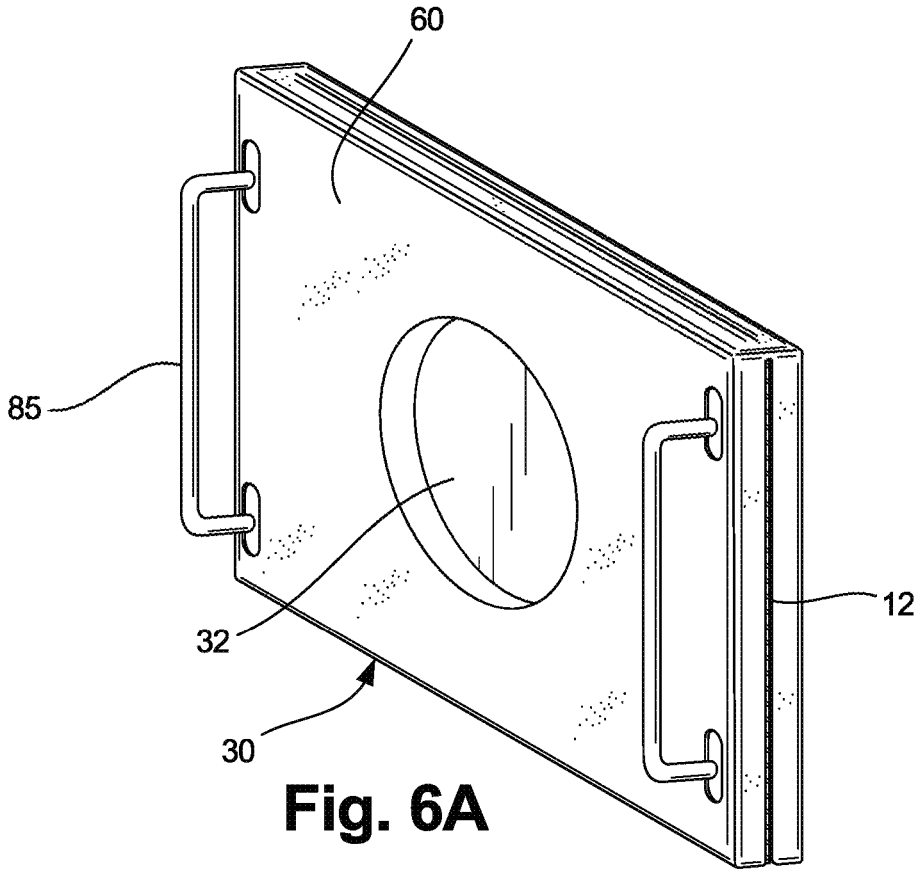
FIG. 6A is a back perspective view of the martial arts training apparatus of the present invention in its closed position showing the handles and a mechanical box for activating sounds and lights on the back side of the apparatus.
Figure 7:
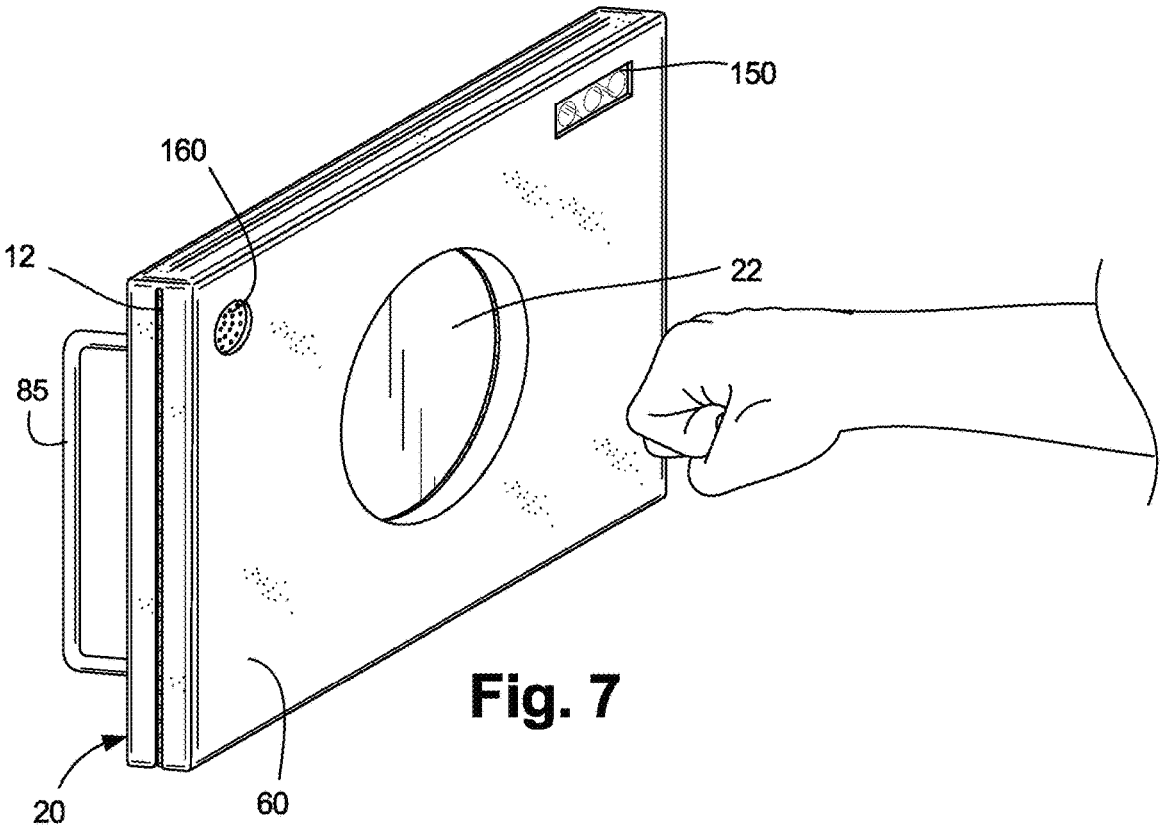
FIG. 7 is a perspective view of one preferred embodiment of the martial arts training apparatus of the present invention with a sound speaker, and lights visible from a front side of the present invention.
Figure 7A:
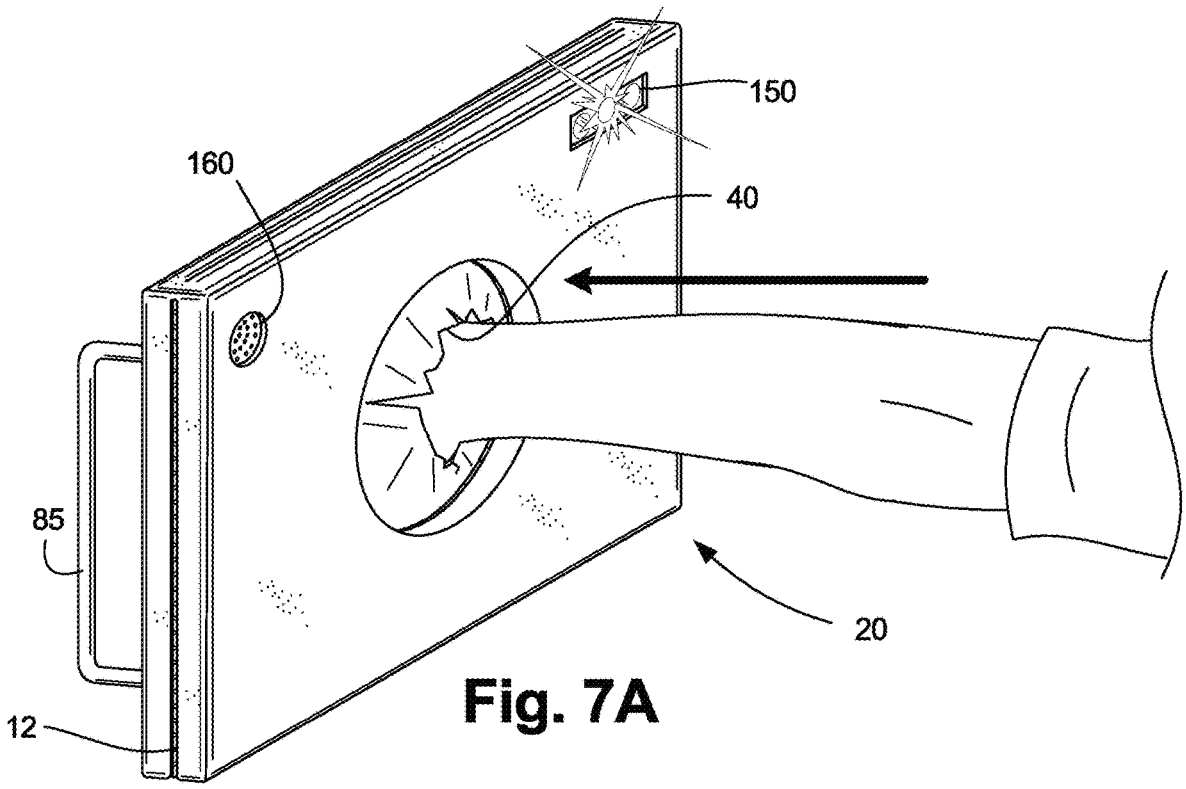
FIG. 7A is a perspective view of one preferred embodiment of the martial arts training apparatus of the present invention in a closed position with a student first striking the target, triggering a sound and turning on the lights.

A target 40, typically composed of a paper product or other penetrable material, is placed between mats 20 and 30 so that in the folded position, the openings 22 and 32 in mats 20, 30, respectively, are obstructed by the target 40. (See FIGS. 1 and 3A.)

In one preferred embodiment, target 40 may be of any desired color, texture or strength provided it can be penetrated when properly struck by a student. By way of example, target 40 can be roll paper, regular paper, thick or card stock paper, common scrap paper such as recycled office paper, or even spam mail or discarded magazine pages for cost effective use. Target 40 may also have drawings or pictures on it to help students focus on hitting the target or simply for entertainment or novelty.

In an alternate embodiment, target 40 might be made of an elastic material that will stretch when struck, but not break or not break unless specific strike criteria are met, to mimic the response when striking a human body.

In one preferred embodiment, the mats are made of foam rubber, low or high density or have a high-quality, multi-density foam core. Outside punching surfaces of each mat may be covered by a smooth, non-slip vinyl 60 or similar material that will protect the mat and reduce scrapes on the hand or foot of a student. The inside surface of each mat is covered with an anti-skid, low density foam 70 for engaging the target 40 and holding it in place.

A front or strike surface of the mats are padded sufficiently to protect students from injury, protect the components of the training apparatus, optimize the shock absorption capability of the training device and to maintained rigidity of the training device.

Figure 9:
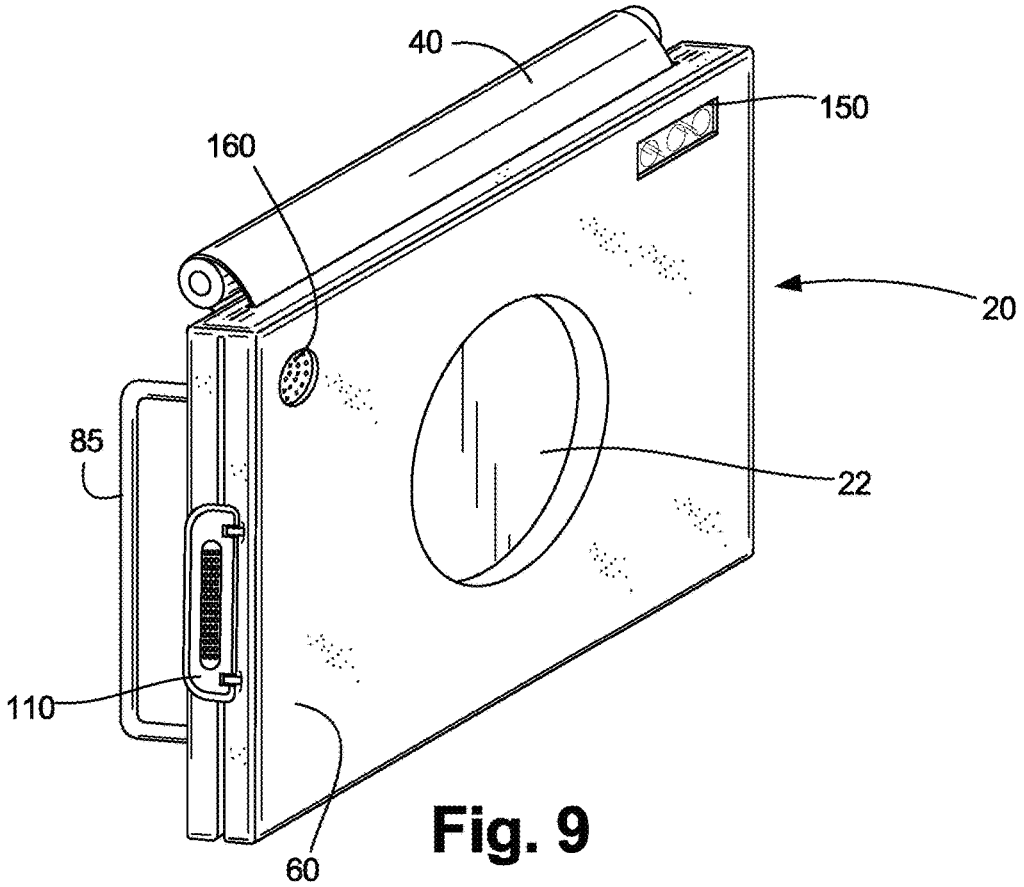
FIG. 9 is a perspective view of one preferred embodiment of the martial arts training apparatus of the present invention in a closed position shown with a roll of paper attached to the top of the back mat.
Figure 9A:
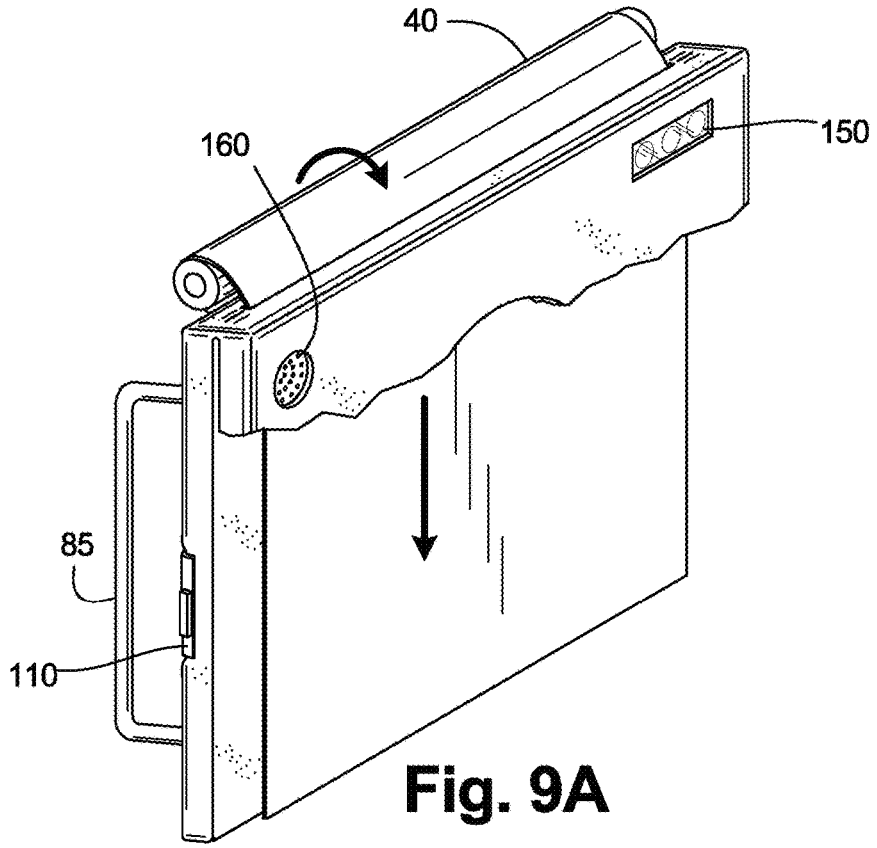
FIG. 9A is a perspective view of one preferred embodiment of the martial arts training apparatus of the present invention with the front mat cutaway to show the paper being fed between the mats from the edge of the mats.

In one preferred embodiment shown in FIGS. 9 and 9A, the martial arts training tool 10 may be formed such that a recess is formed between adjoining interior surfaces of the mats 20, 30 when in the closed position. A scroll of paper is attached to one of the mats so that the paper can be fed continuously through the recess. After each use of the martial arts training apparatus 10, when the paper has been broken by a strike, the paper can continue to be scrolled through the recess quickly and conveniently to accommodate the next student.

In one preferred embodiment, a sound mechanism can be attached to one or more of the mats so that if the student properly strikes the target 40 within the mat openings 22, 32, a sound is emitted to indicate an accurate punch or kick. The sound device can be programmed to emit a different sound for glancing blows or misses. A small speaker 90 can be recessed in the front of one or more mats for projecting the sound to the student. Additionally, speakers might be recessed into the exterior face of one or both mats (for reversibility).

In one preferred embodiment, a light mechanism 100 can be added to one or more of the mats so that if the student properly strikes the target 40 within the mat openings 22, 32, light will be emitted to indicate an accurate punch or kick. The light mechanism can be programmed to emit a different light for glancing blows or misses. Additionally, lights might be recessed into the exterior face of one or both mats (for reversibility).

In one preferred embodiment of the present invention, handles 85 are attached to the back mat for the purpose of holding and gripping the mat securely when the target is struck.

Figure 8:
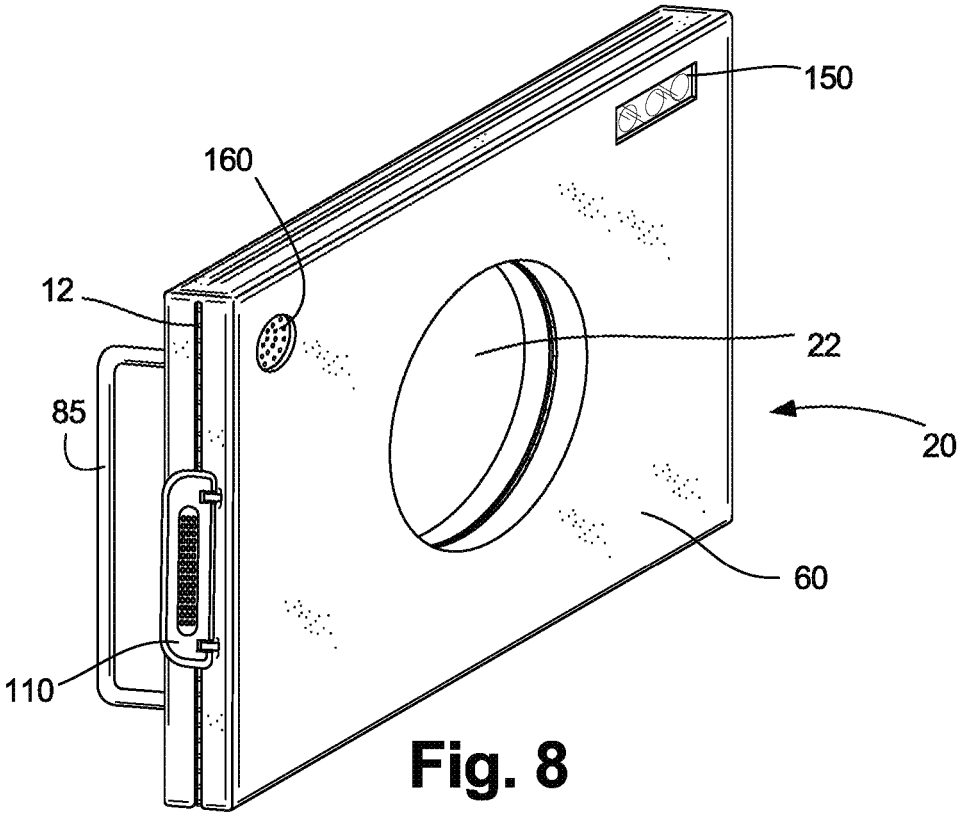
FIG. 8 is a perspective view of one preferred embodiment of the martial arts training apparatus of the present invention in a closed position with latches attached to the front mat engaging a tab in the back mat to secure the two mats together.
Figure 8A:
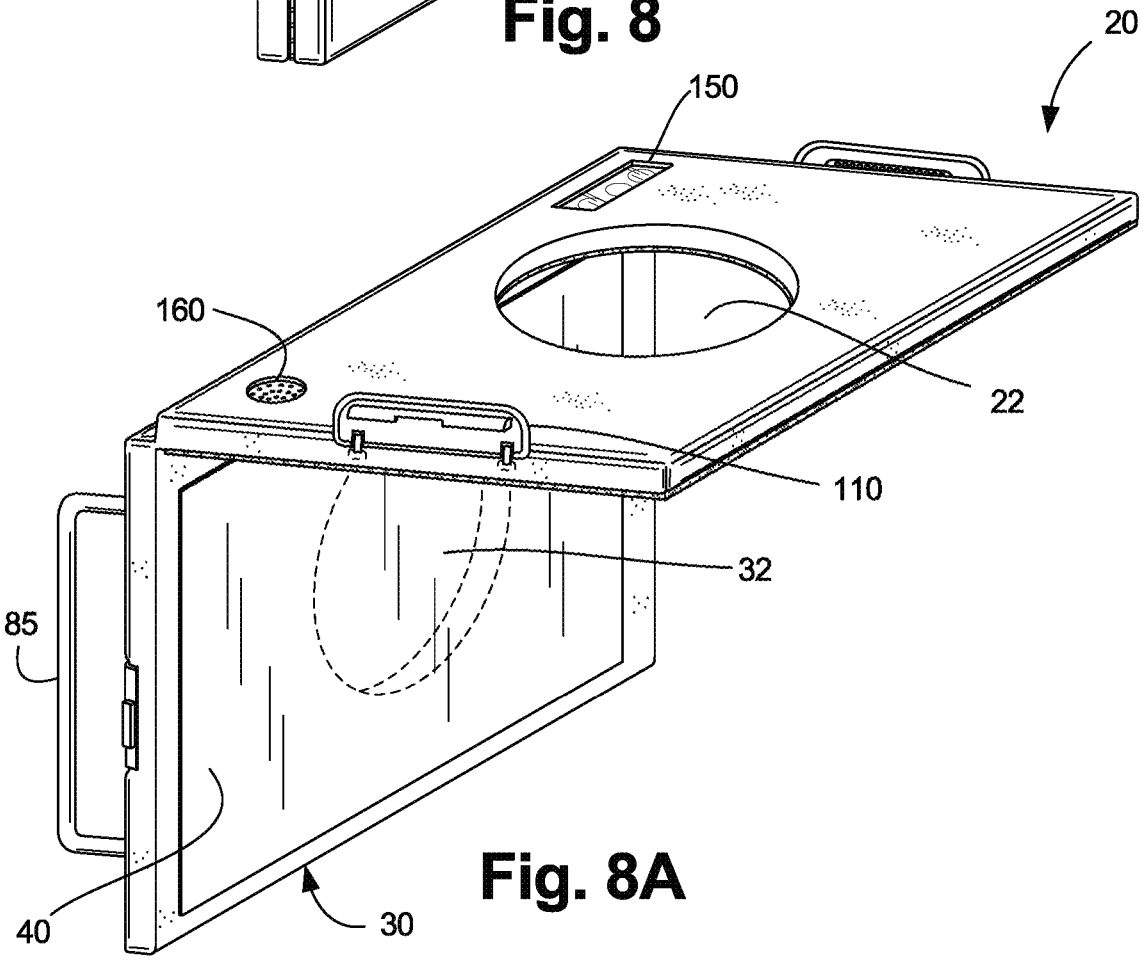
FIG. 8A is a perspective view of one preferred embodiment of the martial arts training apparatus of the present invention in an open position showing the latch attached to the front mat disengaged from the tab in the back mat.

In another preferred embodiment of the present invention shown in FIGS. 8 and 8A, latches 110 are attached to one mat to engage the other mat to lock the mats together with the target secured between the mats. Typically, one mat will carry a latch arm and the other mat will carry a mating latch component. The latches are positioned to bring the latching strength as close to the target clamping location as possible to best retain the target in place.

In use, mats 20 and 30 can be held in a closed position by the instructor in front of a student. (Alternatively, a latch mechanism may be employed to keep the first mat 20 and second mat 30 locked in the folded position when the mat is in use for training purposes.) The student aims at and punches a first or foot through the target 40, which causes the target 40 to break. If the student strikes any portion of the mat, the student will not be injured. Once the target is broken, the mats are separated (like opening book covers) and the target 40 is removed and replaced with a new target 40. Alternatively, if the paper scroll is used, the paper is drawn through the recess between the mats to display a new target.

In alternate embodiments of the present invention, the size and shape of the mats may be modified to conform to the intended use and for comfort of use. For instance, different shaped mats may be easier to hold for particular applications or different instructors. Likewise, the size and shape of the openings may be adjusted for different applications. When struck by a fist, the openings may be made more rounded; openings for a kick may be more oblong.

One method for modifying the size and shape of the openings is the use of a supplemental mat. The supplemental mat 120 has a smaller size opening 140 than the openings 22, 32 of the training device. The opening 140 of the supplemental mat may be of any desired shape.

Figure 10:
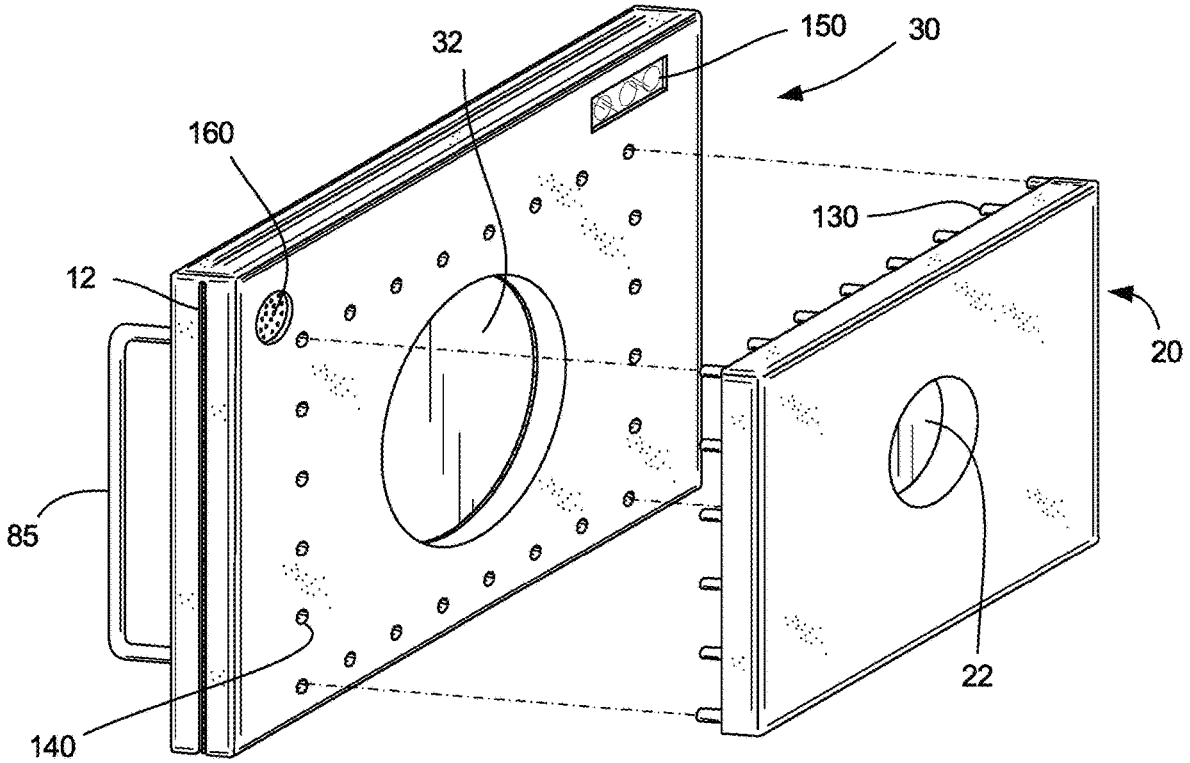
FIG. 10 is a perspective view of one preferred embodiment of the martial arts training apparatus of the present invention shown with the top mat having holes on a front or strike surface for receiving pegs mounted on a back side of a supplemental mat so that the supplemental mat can be mounted to the front mat.
Figure 10A:
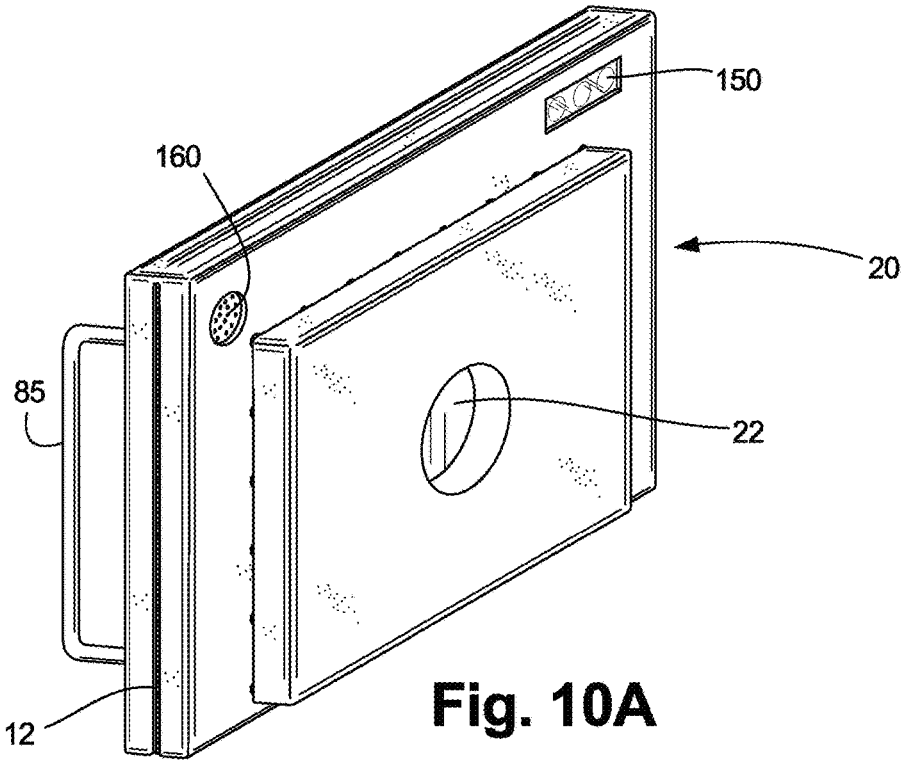
FIG. 10A is a perspective view of one preferred embodiment of the martial arts training apparatus of the present invention shown with the supplemental top mat secured to the apparatus.

As shown in FIGS. 10 and 10A, a supplemental mat 120 is equipped with pegs 130 on a back side of the supplemental mat. In one preferred embodiment, the pegs are screw bosses. Alternatively, and without limitation, plastic thread forming screws or bond threaded inserts can be utilized.

To secure the supplemental mat 120 to the training apparatus, the front mat of the training device is equipped with recesses 140 to receive pegs 130 so that the supplemental mat can be mounted to the front mat.

Other means for securing the supplemental mat to the training apparatus are also anticipated by the present invention.

Figure 15:
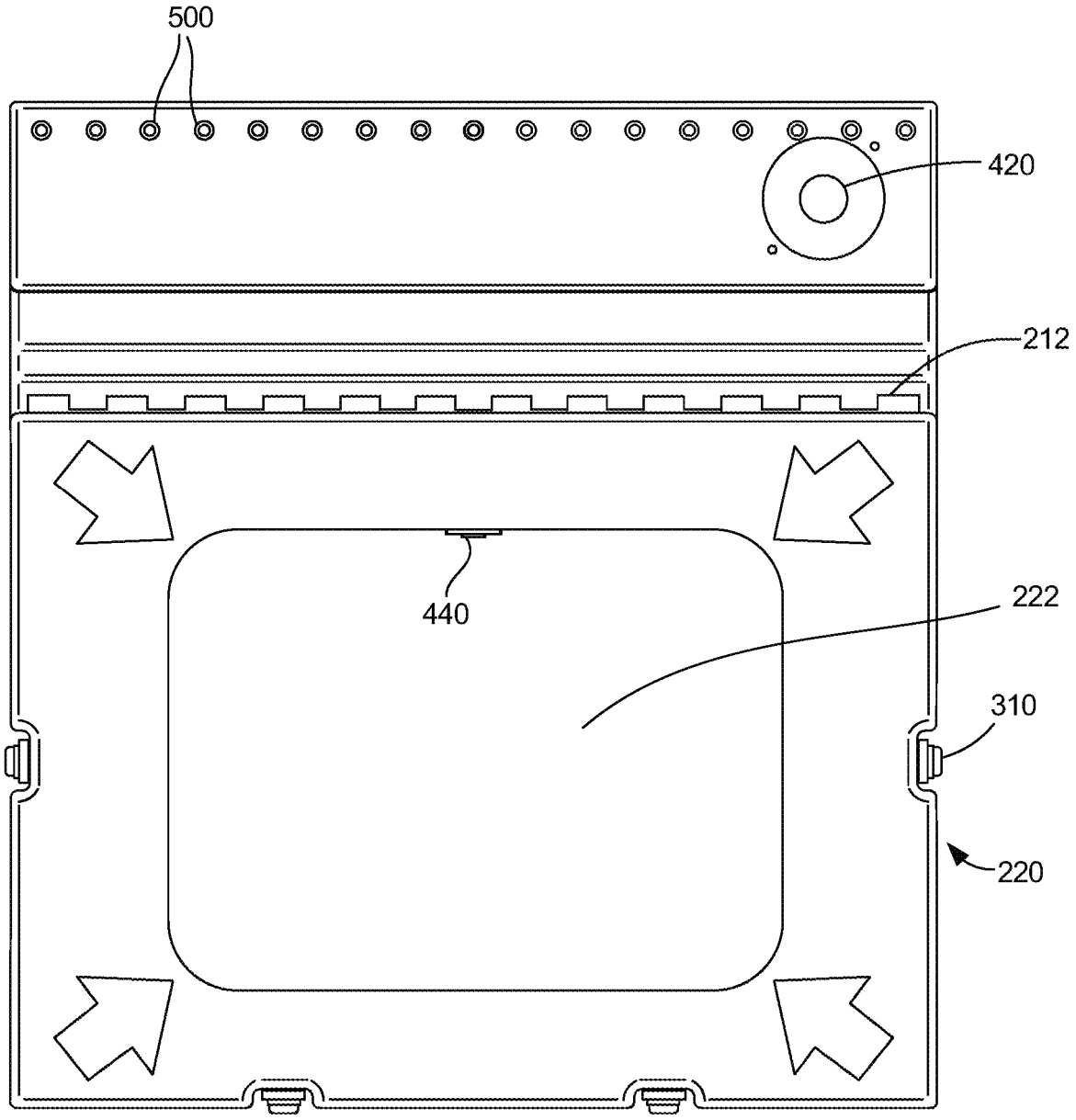
FIG. 15 is front view of the second preferred embodiment of the martial arts training apparatus of the present invention.
Figure 16:
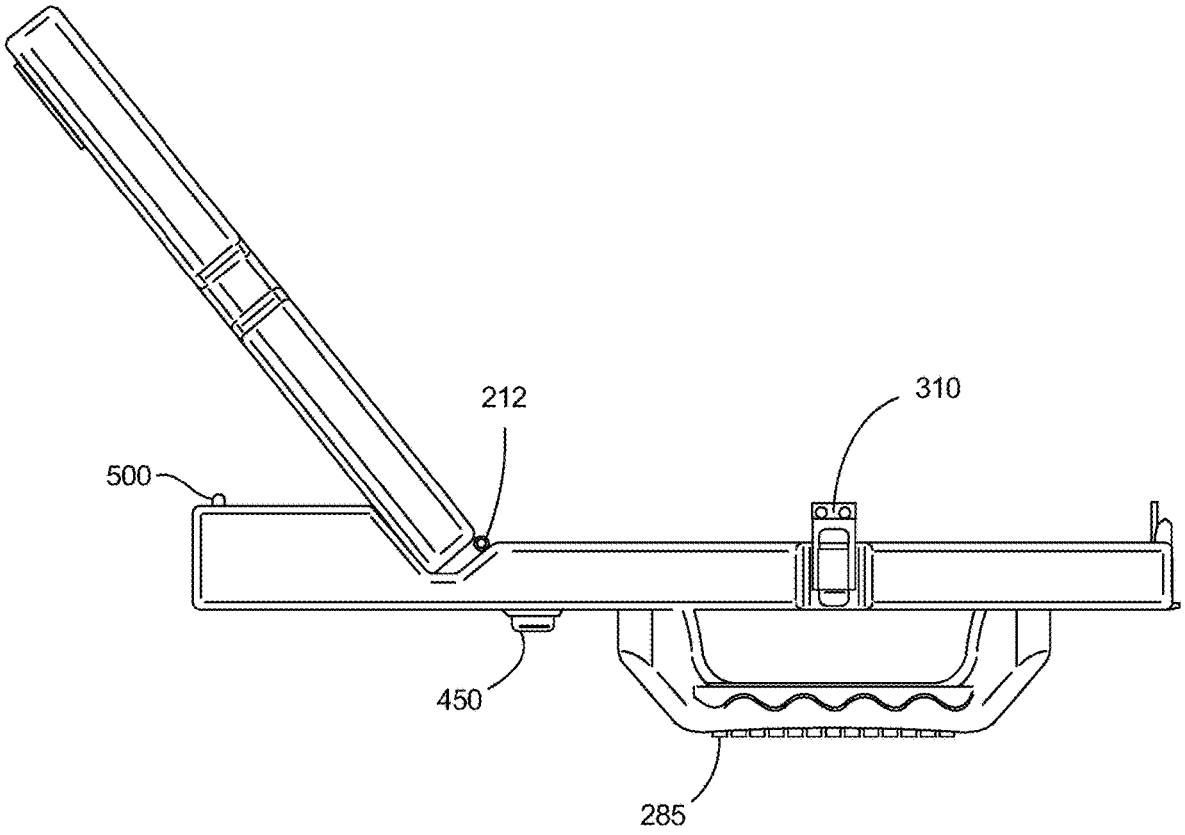
FIG. 16 is a side view of the second preferred embodiment of the martial arts training apparatus of the present invention showing the handles and a side clasp and the front mat in open relation with respect to the back mat.

A second preferred embodiment of the training apparatus is shown in FIGS. 12-20. Referring to FIG. 16, the martial arts training apparatus includes a first or base mat 220 shown as having a generally square configuration. Hinged by hinge 212 to the base mat 220 is a smaller second mat 230. The hinge mechanism can be attached to the foam mats by any known means. Alternatively the first mat 220 and second mat 230 can be integrally formed to fold along a formed hinge 212. The mats are hinged or formed together so that a first mat 220 folds over a portion of the second mat 230 like a book or cover.

Figure 12:
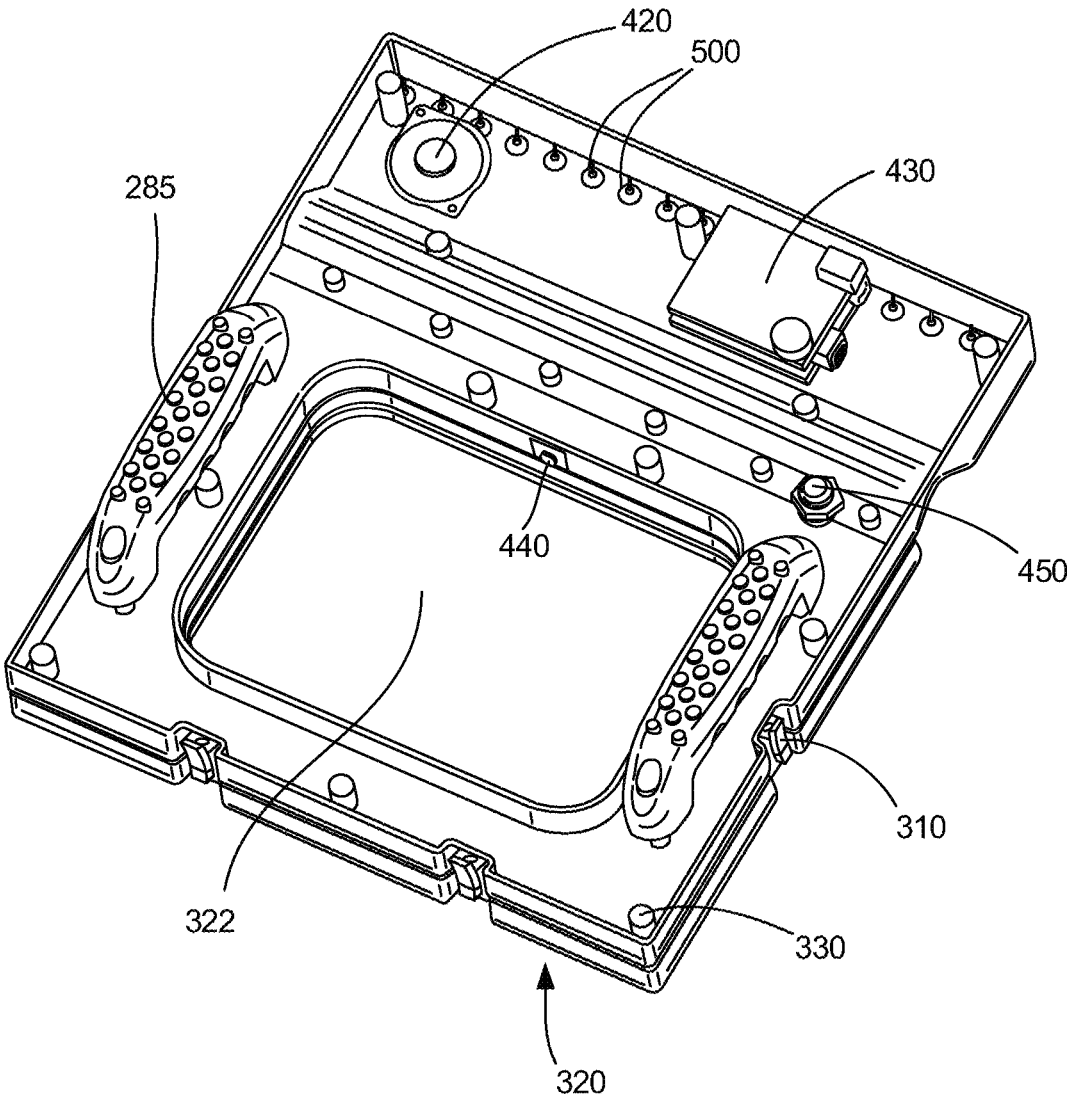
FIG. 12 is a perspective view of the back side of a second preferred embodiment of the martial arts training apparatus of the present invention having a large back mat and smaller front mat hinged thereto, and further illustrating light and sound mechanisms and handles secured thereto.
Figure 13:
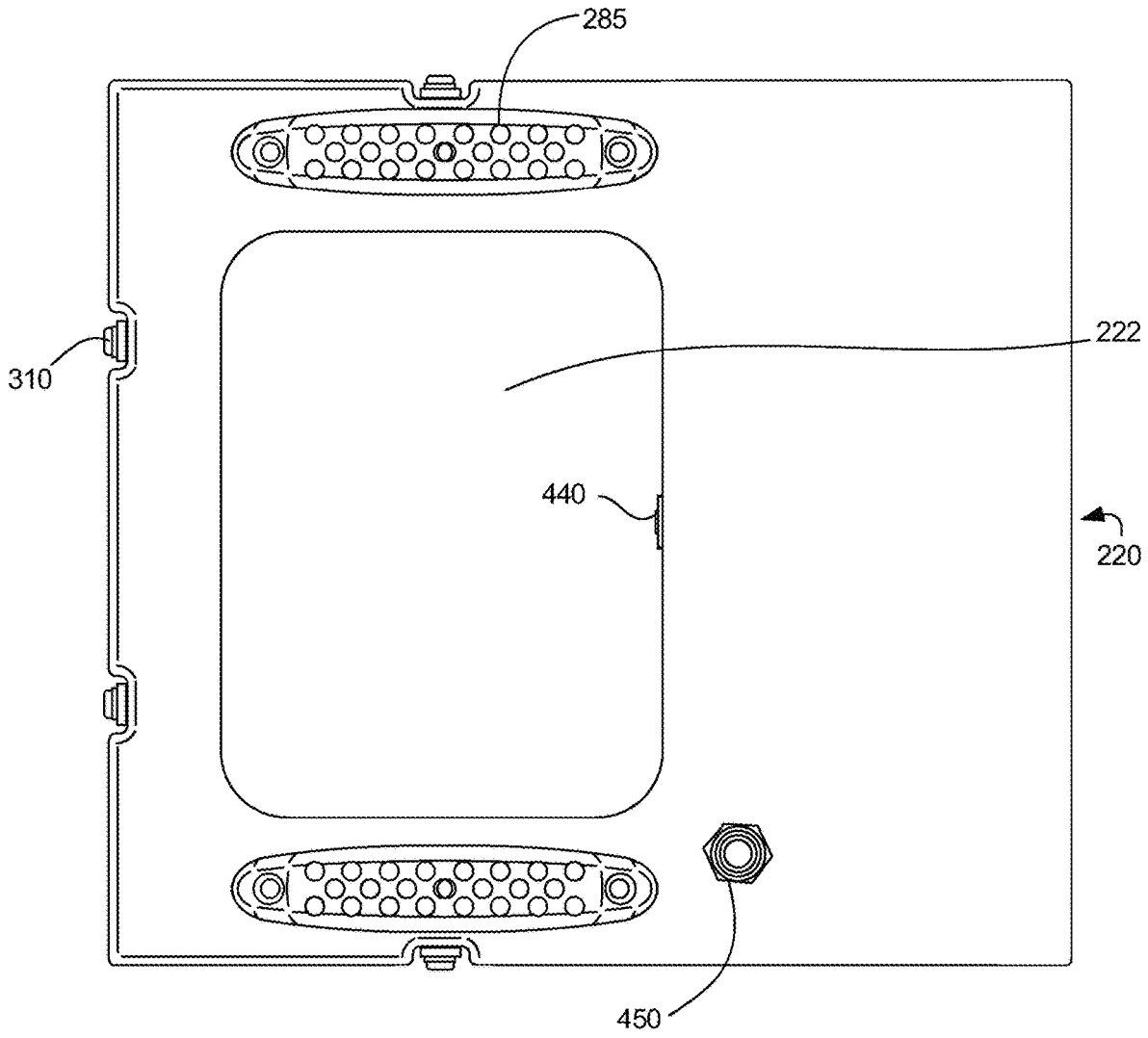
FIG. 13 is a partial edge view of the mats in a closed position with a paper mounted between, illustrating the tooth and groove arrangement of the mats for gripping the paper.
Figure 14:
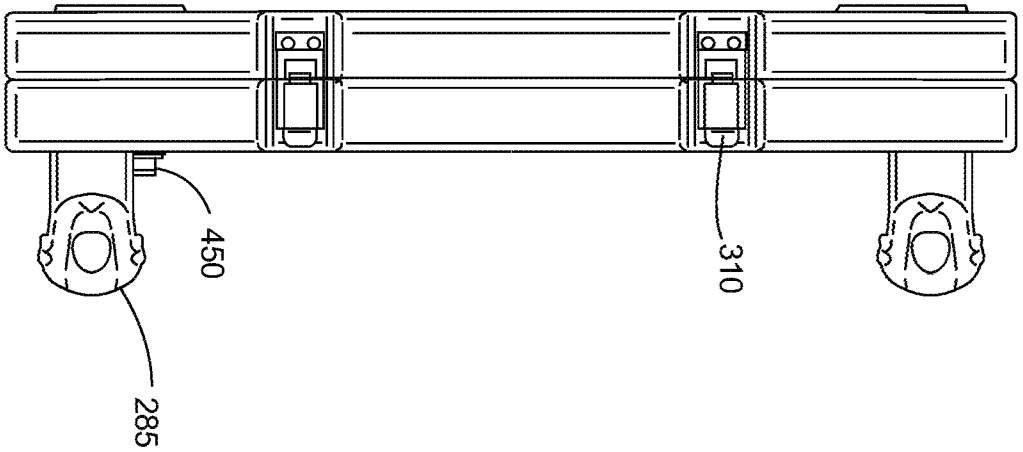
FIG. 14 is a top view of the second preferred embodiment of the martial arts training apparatus of the present invention showing the handles and a pair of front clasps for securing the front and rear mats together in closed relation.
Figure 17:
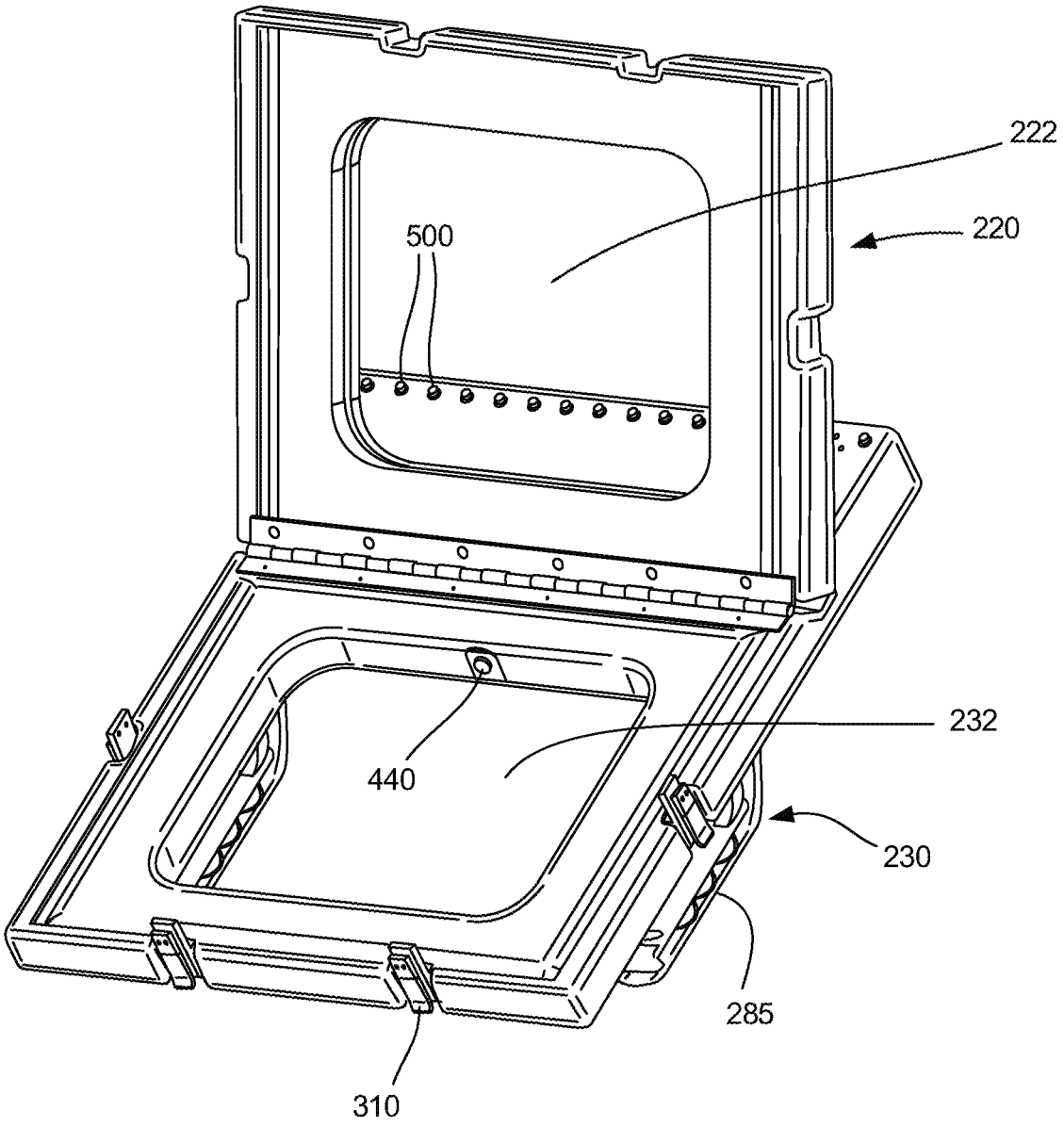
FIG. 17 is a perspective view of the second preferred embodiment of the martial arts training apparatus of the present invention with the front mat in its open position.
Figure 18:
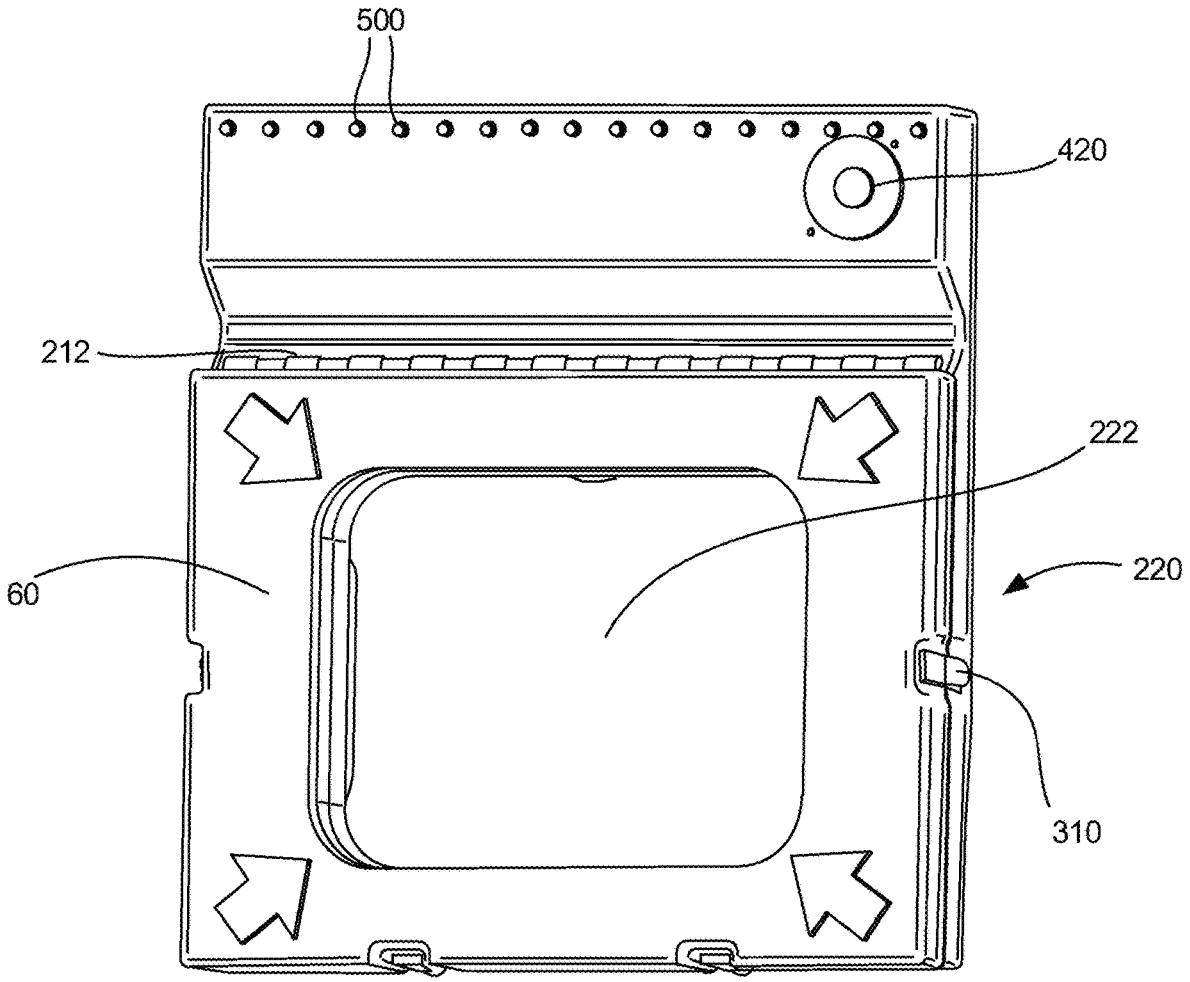
FIG. 18 is a perspective view of the front side of the second preferred embodiment of the martial arts training apparatus of the present invention with the front mat in closed relation with the back mat.
Figure 19:
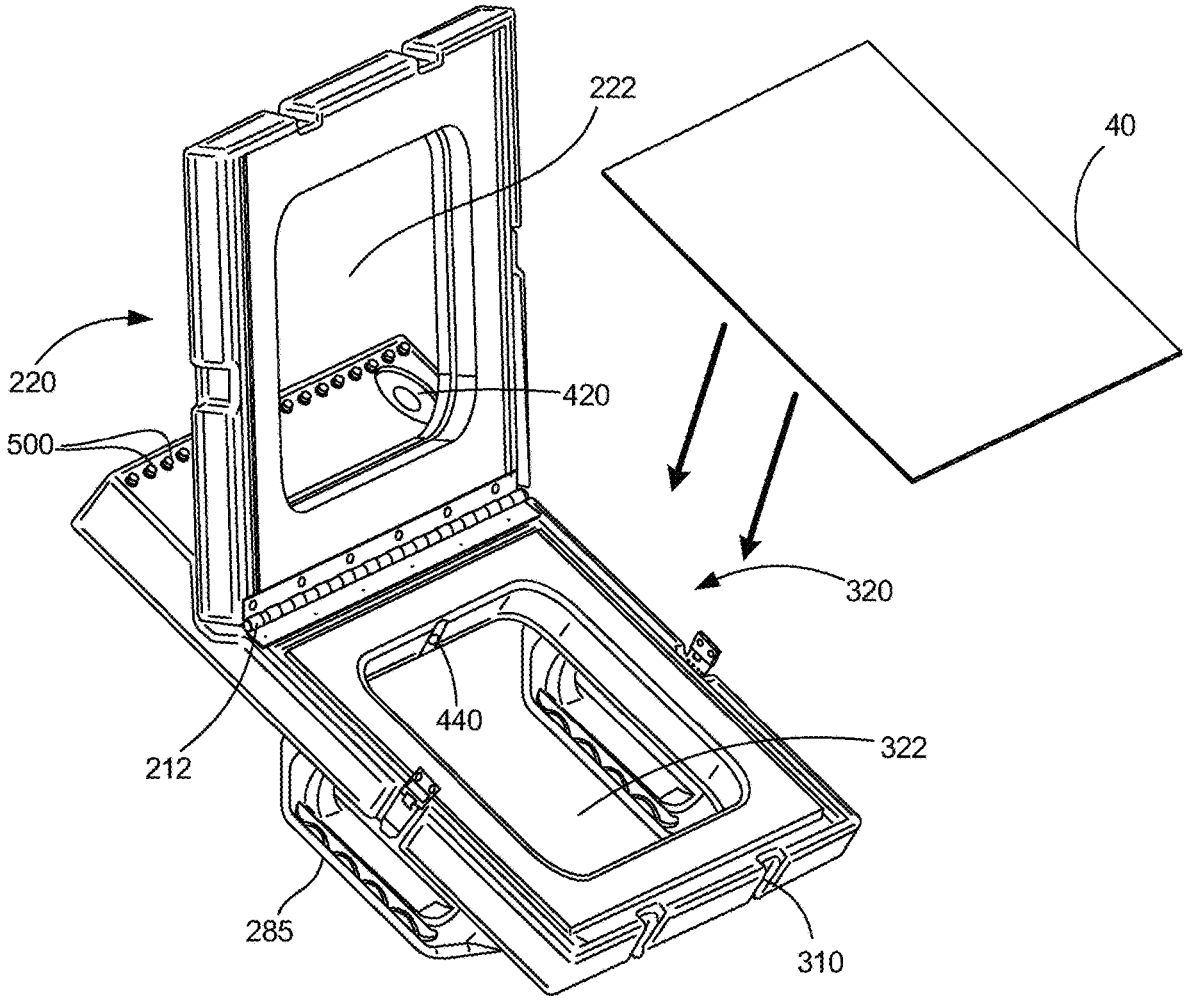
FIG. 19 is a perspective view of the front side of the second preferred embodiment of the martial arts training apparatus of the present invention with the front mat in open relation with the back mat to receive a paper target.

Mat 220 defines an opening 222 and mat 230 defines an opening 232 (see FIG. 17). Opening 232 is generally centered in the mat 230. Because base mat 220 is larger than second mat 230, the opening 222 in the base mat is offset from center but is positioned to align with the opening 222 when second mat 230 is in a folded (closed book) position as shown in FIG. 12.

A target 240, typically composed of a paper product or other penetrable material, is placed between mats 220 and 230 so that in the closed position, the openings 222 and 232 in mats 220, 230, respectively, are obstructed by the target 240. (See FIG. 20.)

Again, target 240 may be of any desired color, texture or strength and have drawings or pictures on it to help students focus on hitting the target or simply for entertainment or novelty.

Figure 20:
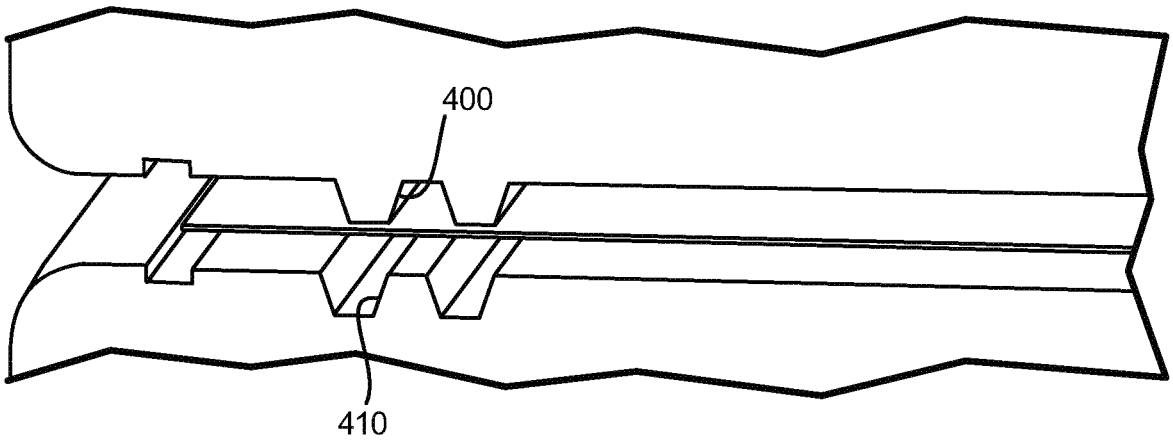
FIG. 20 is a perspective view of an edge of the second preferred embodiment of the martial arts training apparatus of the present invention illustrating how target paper is loaded and gripped between the front and back mats.

As shown in FIG. 20, the base and second mats have interior surfaces that are adjoining when the mats are in the closed position. One mat interior surface can be equipped with at least one rib 400 and the other mat interior surface can define at least one groove 410 corresponding to the rib on the first mat. When the second mat is in the closed position with a target positioned between the first and second mats, the target is gripped between the rib and corresponding groove 410 to hold it in place.

A pair of grooves 460 defined in an interior surface of one of the mats or a different type of "marker" can be used to mark the edges of where targets are to be mounted within the training device.

A sound mechanism 420 can be attached to one or more of the mats so that if the student properly strikes the target 240 within the mat openings 222, 232, a sound is emitted to indicate an accurate punch or kick. The sound device can be programmed to emit a different sound for glancing blows or misses. The sound mechanism can be recessed in the front of one or more mats for projecting the sound to the student.

In one preferred embodiment, a light mechanism 430 can be added to one or more of the mats so that if the student properly strikes the target 240 within the mat openings 222, 232, light will be emitted to indicate an accurate punch or kick. The light mechanism can be programmed to emit a different light for glancing blows or misses.

To assist a student to strike the target, LED lights can be mounted on the front of the training apparatus, such as along the top as shown in FIG. 15. These LEDs may be of any desired color and configuration.

In one preferred embodiment, a proximity sensor 440 is used to detect a strike against the target. The speaker, strike light, LEDs, proximity sensor and battery are, controlled by an Arduino Microcontroller. In one preferred embodiment, a Lithium Polymer (LiPo) battery (not shown) powers the sound and lighting mechanisms. Wire leads run from the microcontroller 430 to the speaker, LEDs 500, battery and proximity sensor 440. The proximity sensor 440 can be recessed into the housing as shown in FIG. 15. The proximity sensor is ideally calibrated for sensing strikes within 0-20 cm of the target, but other ranges are possible.

In another preferred embodiment, a "fail" button 450 can be added close to the handles. In the event the student fails to hit the target correctly, the instructor holding the training device can press the fail button to deliver a fail light (ideally red, but other colors are possible) and a sound indicating a failed strike.

Handles 285 are attached to the back mat for the purpose of holding and gripping the mat securely when the target is struck.

Latches 310 are attached to one mat to engage an attachment bar carried on the other mat for locking the mats together with the target secured between the mats. The latches can be mounted one or all sides of the training device except the hinged side.

In use, a target 240 is positioned over the opening 222 of mat 220, mat 230 is rotated to a closed position and locked into place by latches 310 and an instructor holds the training apparatus by the handles 285 in front of a student. The student aims at and punches a first or foot through the target 240, which causes the target 240 to break. If the student strikes any portion of the mat, the student will not be injured. Once the target is broken, mat 230 is unlatched, rotated to an open position, and the spent or damaged target 240 is replaced with a new target.

Like the first embodiment, the second embodiment is equipped with pegs 330 to accommodate a supplemental mat.

Figure 21:
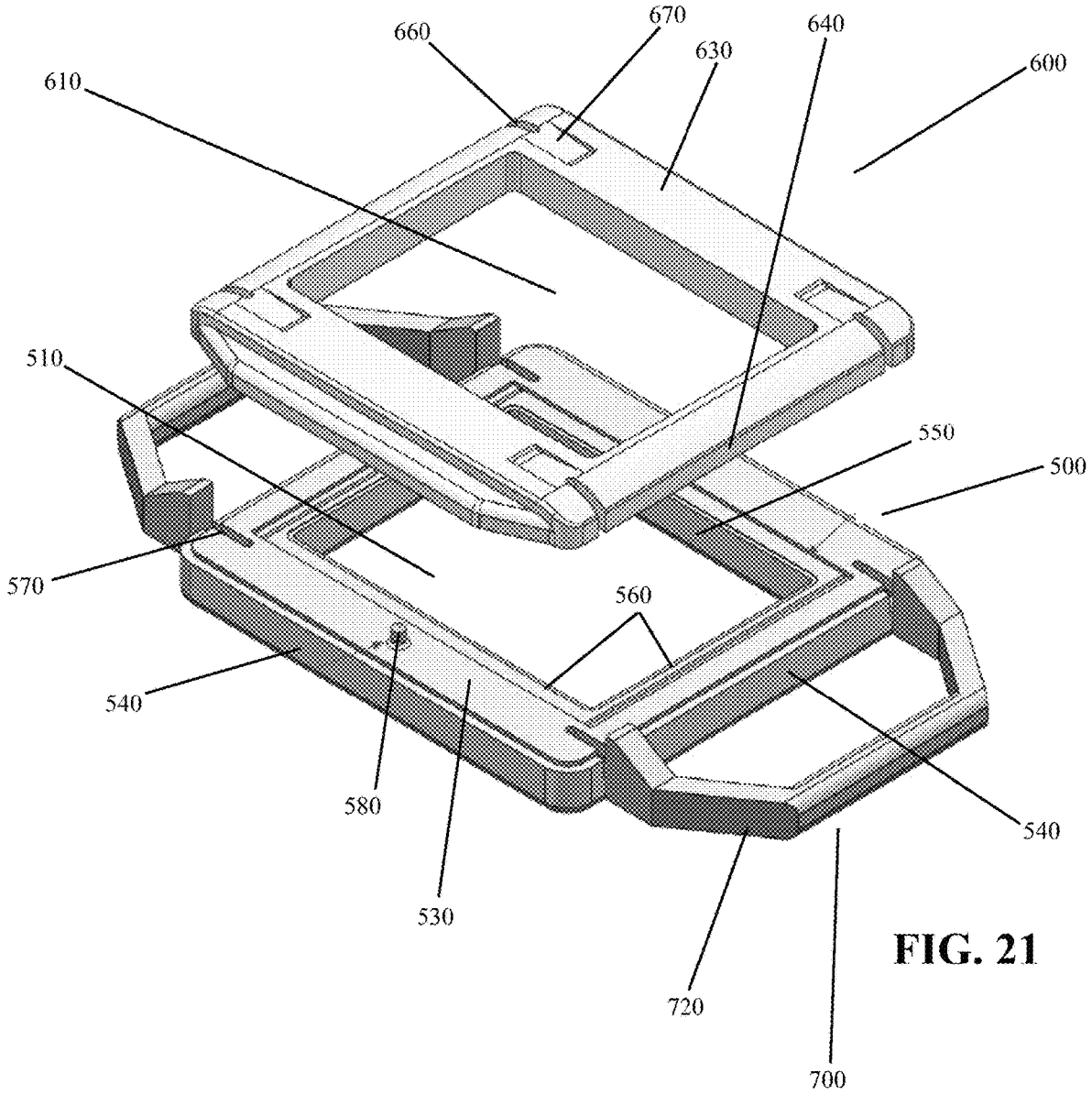
FIG. 21 is an exploded view of a third preferred embodiment of the martial arts training apparatus of the present invention.
Figure 22:
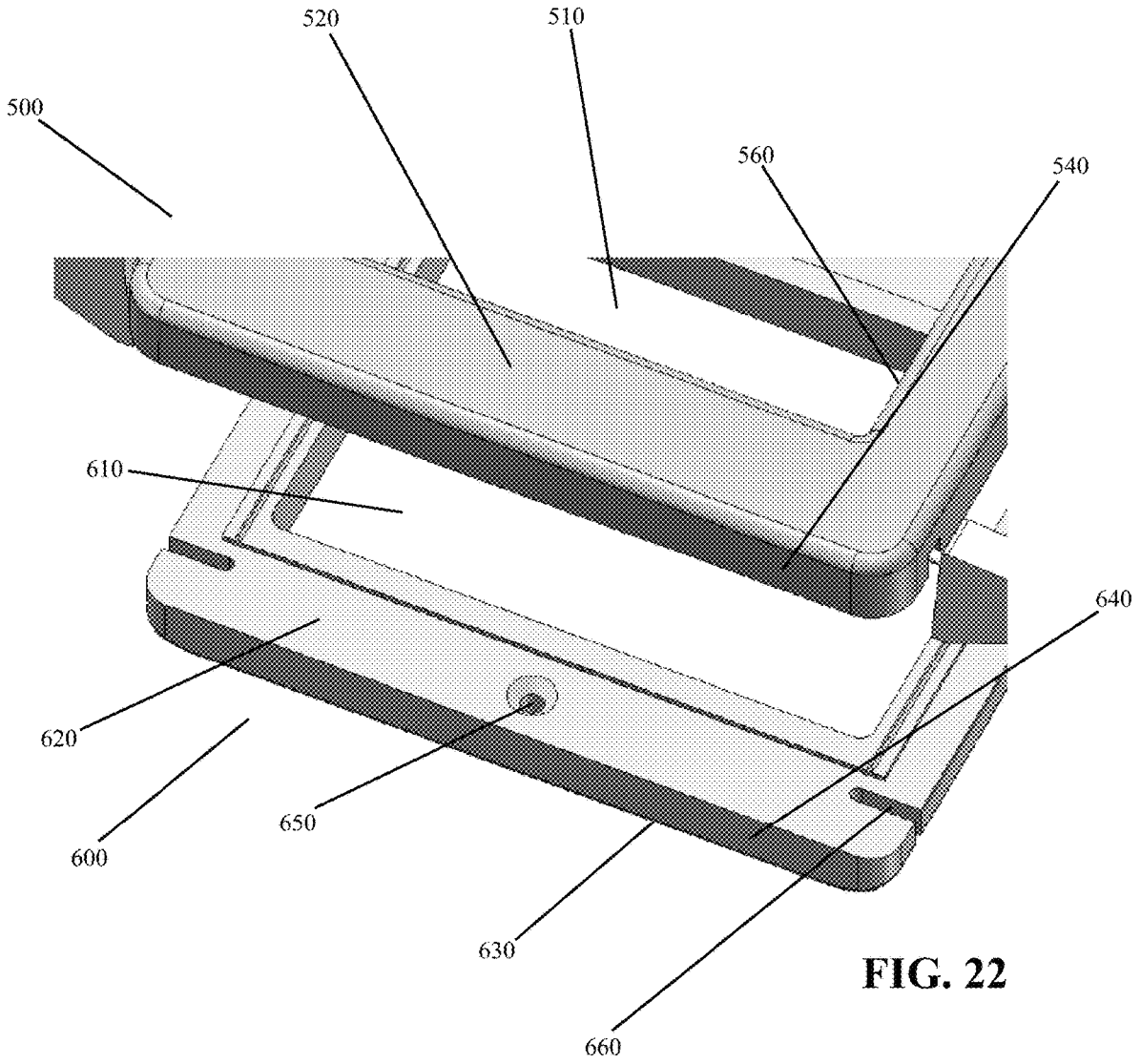
FIG. 22 is a partial edge view of the first and second mats in a disengaged orientation.

A third preferred embodiment of the martial arts training apparatus is shown in FIGS. 21-32. Referring to FIG. 21, the third embodiment of the martial arts training apparatus includes a first mat 500, illustrated as having a generally square or rectangular "picture-frame" configuration defining an opening 510, and a second mat 600 illustrated as having a generally square or rectangular "picture-frame" configuration defining an opening 610. In one embodiment, opening 610 is at least as large as the opening 510 in first mat 500.

First mat 500 includes a front side 520 (FIG. 26) and a back side 530 (FIG. 21) and has four side members 540 as shown in FIG. 21.

On the back side 530 of the first mat 500, along an inner edge 550 of the side frame members 540, and formed along the entire periphery of the opening 510, is a recess 560. Recess 560 forms the outer edge of a "paper tray" for receiving a sheet of paper or other sheet material (the "target") to be struck by a martial arts participant using the present invention. The target should be capable of breaking upon impact as described hereinabove, or evidencing a scuff or strike mark to identify the location of a strike against the target.

Rotatably mounted on each of two opposite members of the first mat are two handles 700. Handles 700 may be pivotally attached to the first mat by any known means, at one or more pivot points. In the embodiment illustrated (FIG. 27), handles 700 have a generally "U" shape. Pivot bolts 710 extend from each leg 720 of the handles. Each pivot bolt 710 has a distal end 712 on which is mounted a barrel nut 714. Each barrel nut 714 is releasably, slidably mounted within a corresponding "T-shaped" barrel channel 570 formed in a first mat member (FIGS. 30-32) to rotatably secure handles 700 to the first mat 500.

Handles 700 also include lateral extensions 750 extending substantially perpendicular to a plane of the handle at the handle base. These handle lateral extensions are used to secure the first and second mats in a locked mating relation.

Other handle configurations and methods of attaching the handles to the first mat 500 are anticipated by the present invention, which may require one or more pivot points.

The pivot bolt 710 has sufficient length to permit the pivot bolts 710 to freely rotate through the "T—shaped" channels 570 between an unlocked position extending in generally planar fashion from opposite sides of first mat 500, to a locked position extending generally perpendicular to and spaced above the plane of the back side 530 of the first mat 500.

Extending outward from the back side 530 of the first mat is at least one and preferably two or more alignment pegs 580.

The second mat 600 includes a front side 620 (FIGS. 21, 22) and a back side 630 (FIG. 21) and has four side members 640.

The front side 620 of the second mat 600 includes alignment bores 650 that correspond to the alignment pegs 580 of the first mat. These bores may be countersunk to assist in alignment with pegs 580 of the first mat 500. The alignment bores 650 of the second mat mate to align the first mat and its opening 510 with the second mat and its openings 610.

Figure 23:
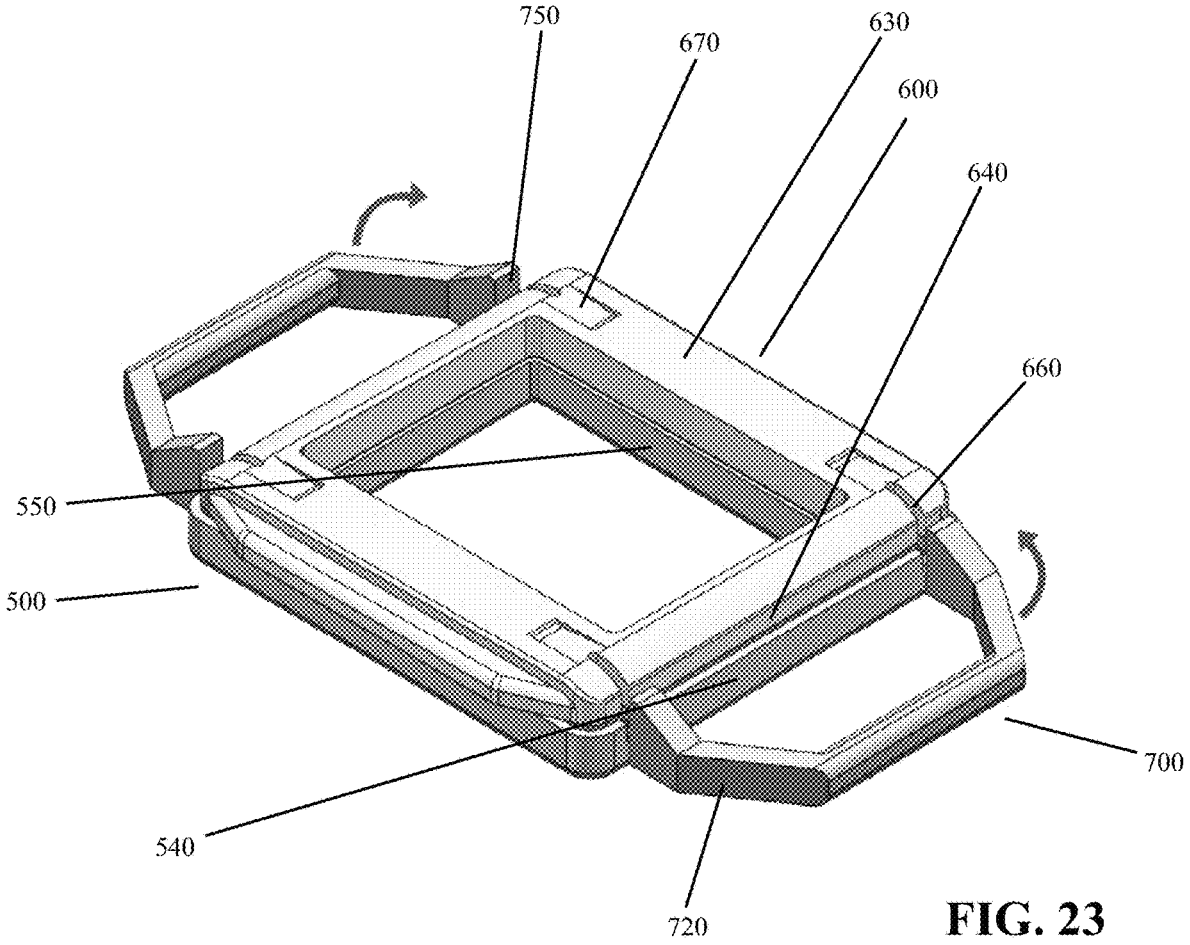
FIG. 23 is a perspective view of the third preferred embodiment of the martial arts training apparatus of the present invention showing the first and second mats mounted together and the handles in an unlocked position.
Figure 24:
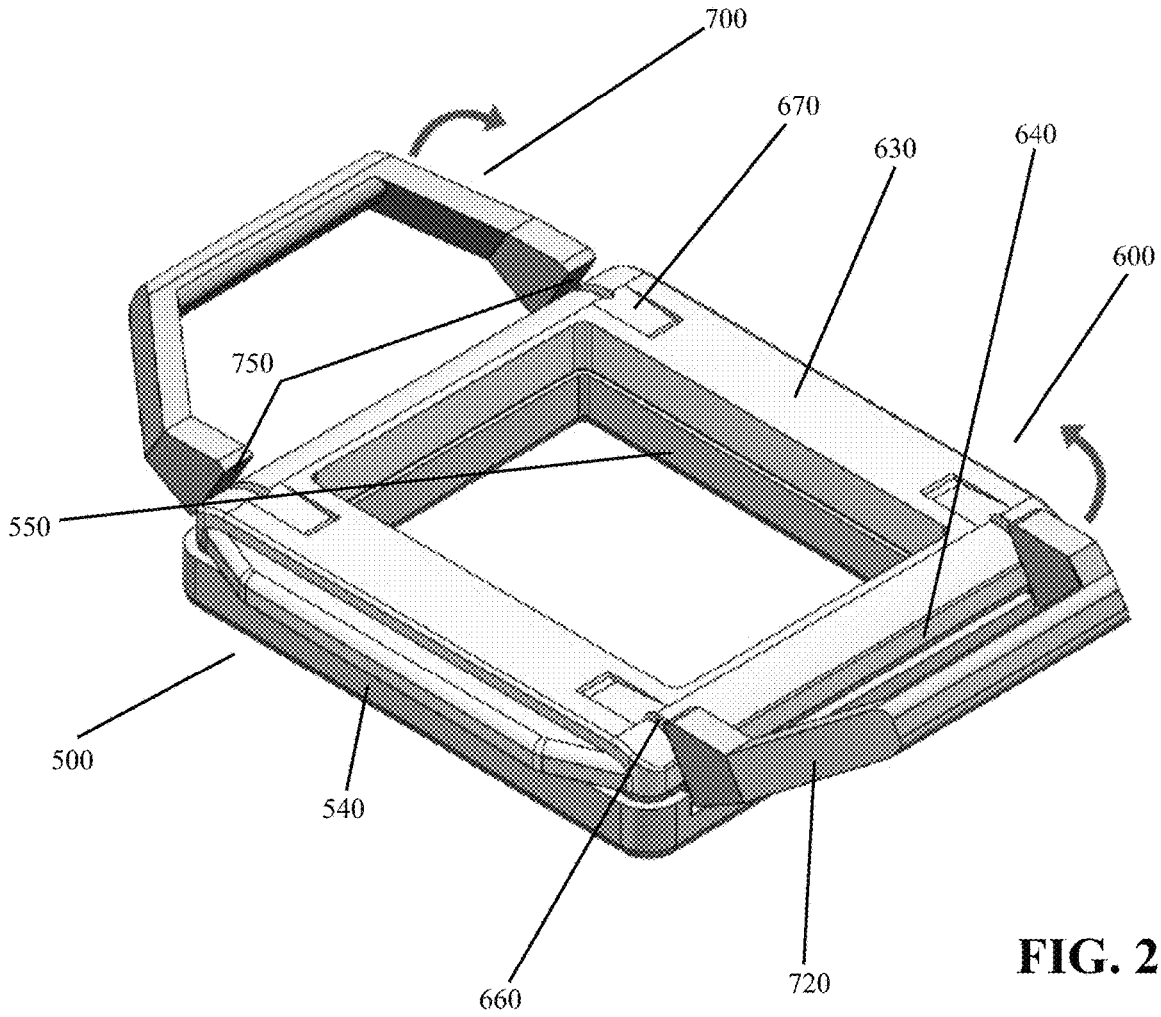
FIG. 24 is a perspective view of the third preferred embodiment of the martial arts training apparatus of the present invention showing the first and second mats mounted together and the handles rotated towards the locked position.
Figure 25:
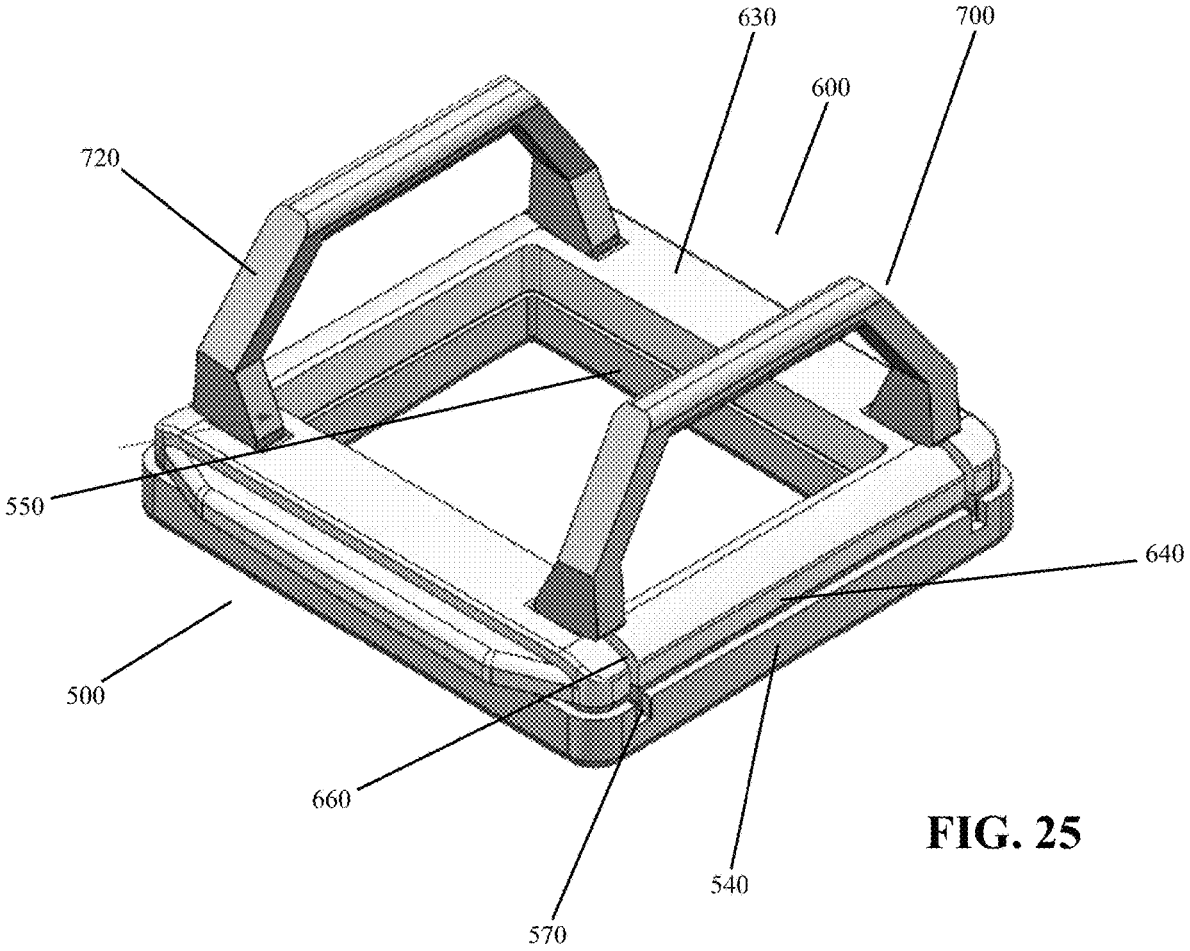
FIG. 25 is a perspective view of the third preferred embodiment of the martial arts training apparatus of the present invention showing the first and second mats mounted together and the handles in a locked position.
Figure 26:
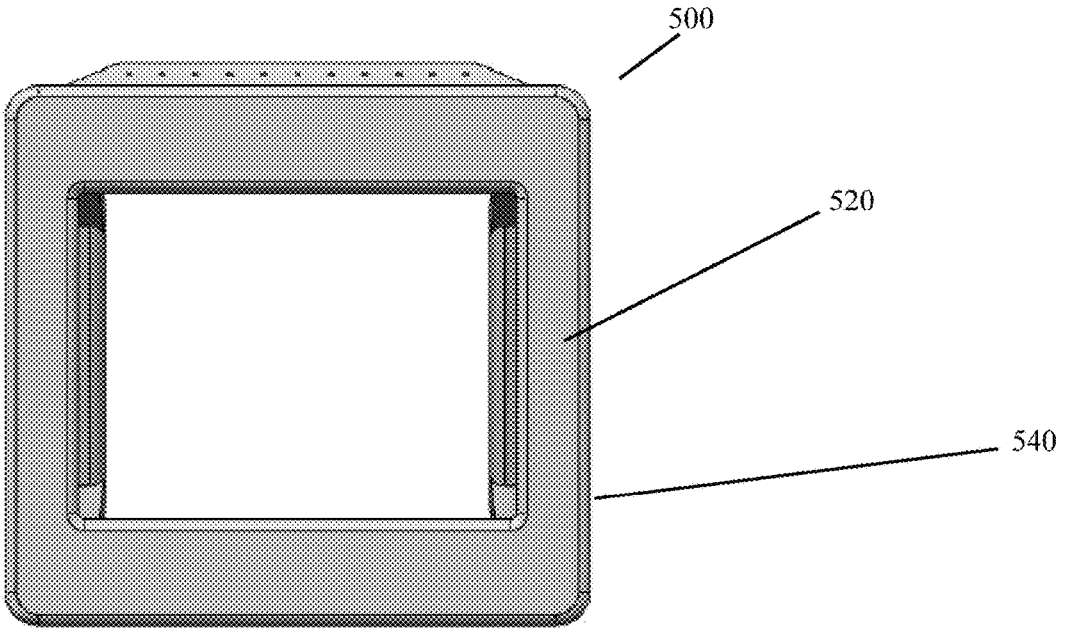
FIG. 26 is a front view of the third preferred embodiment of the martial arts training apparatus of the present invention.
Figure 27:
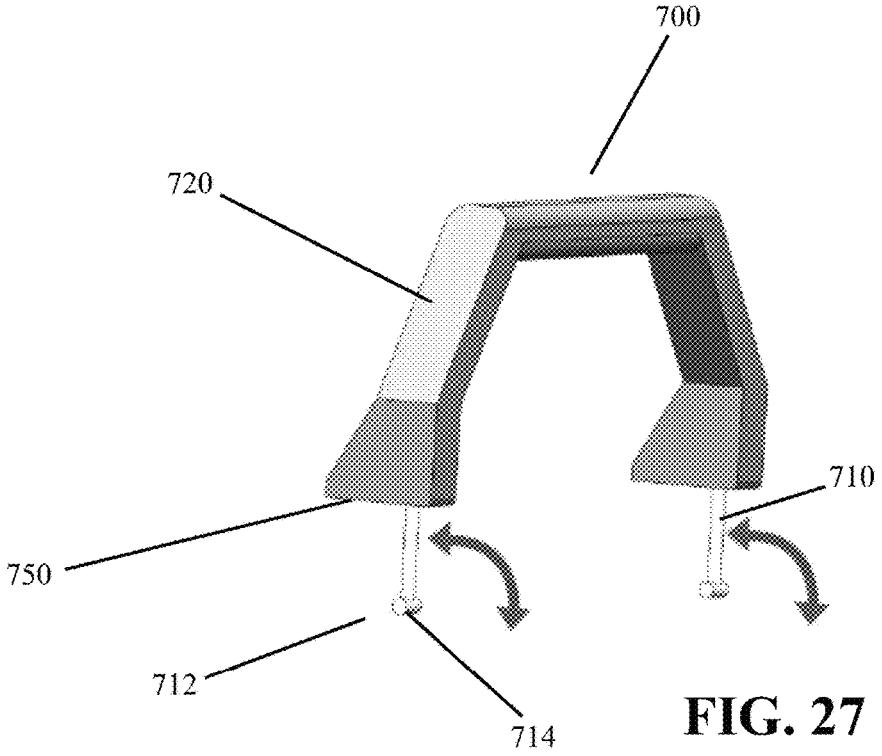
FIG. 27 is a perspective view of a handle used with the third preferred embodiment of the martial arts training apparatus of the present invention.
Figure 28:
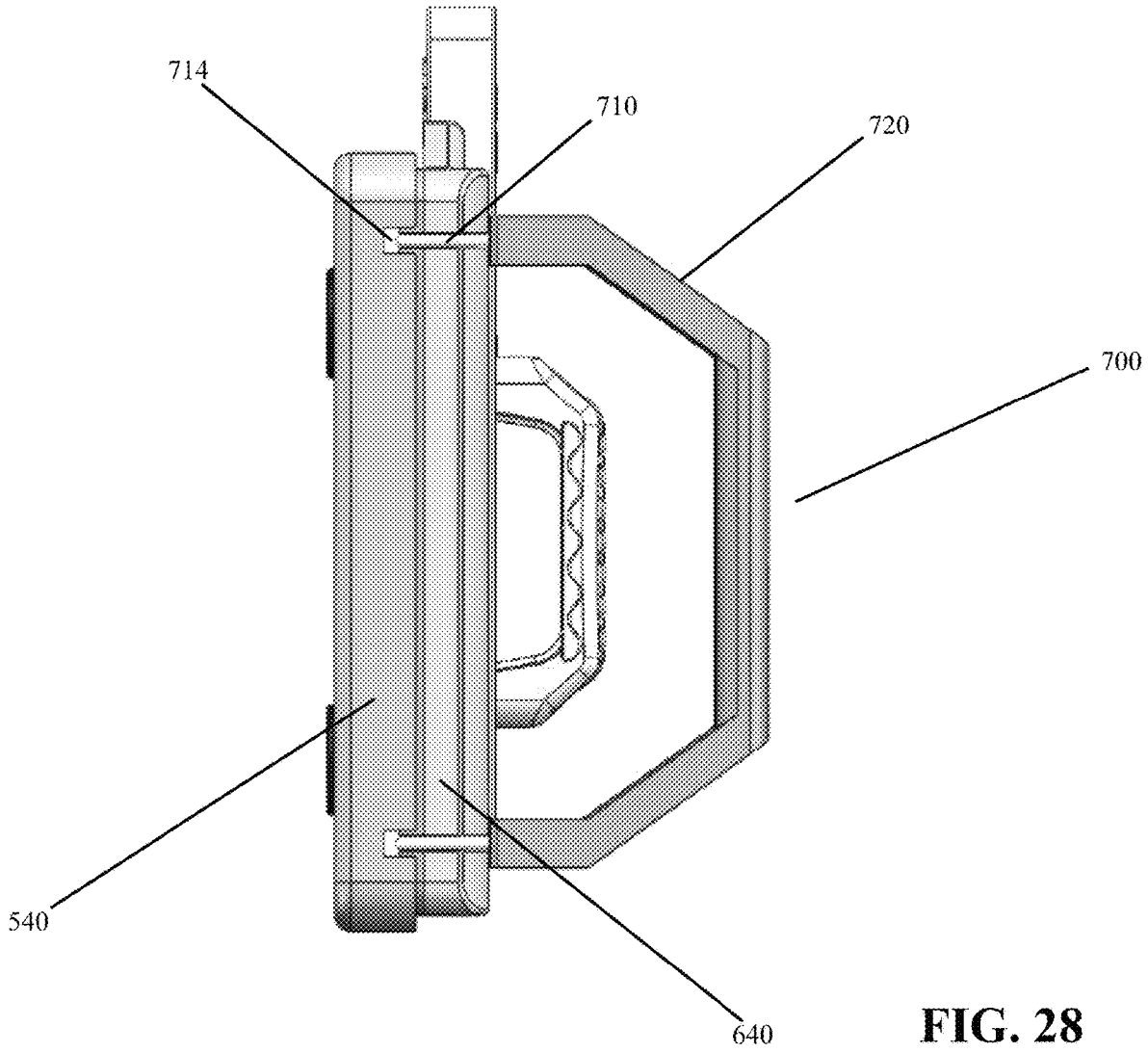
FIG. 28 is a side view of the third preferred embodiment of the martial arts training apparatus of the present invention with the handles in their locked position.
Figure 29:
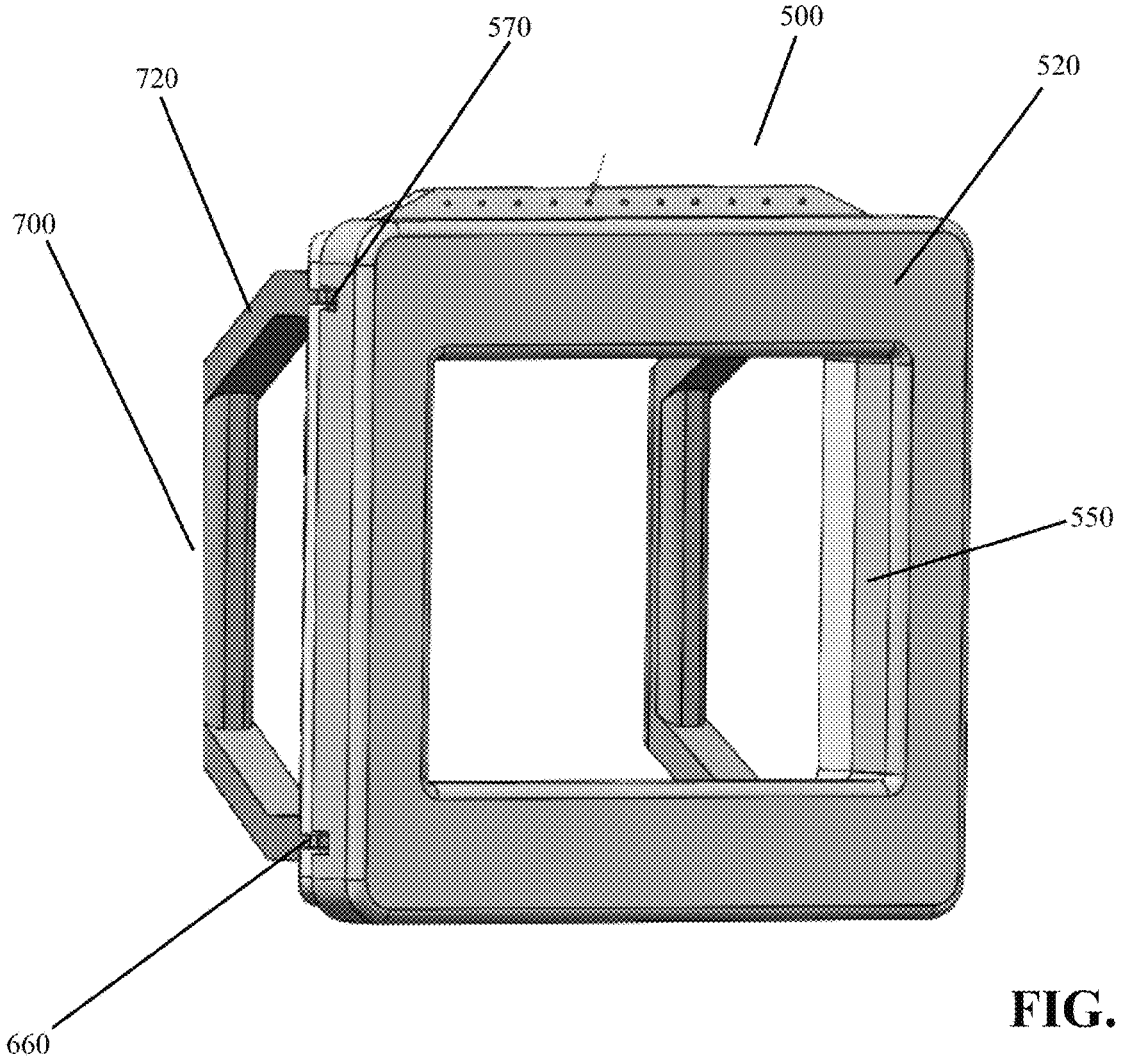
FIG. 29 is a perspective view of the third preferred embodiment of the martial arts training apparatus of the present invention.
Figure 30:
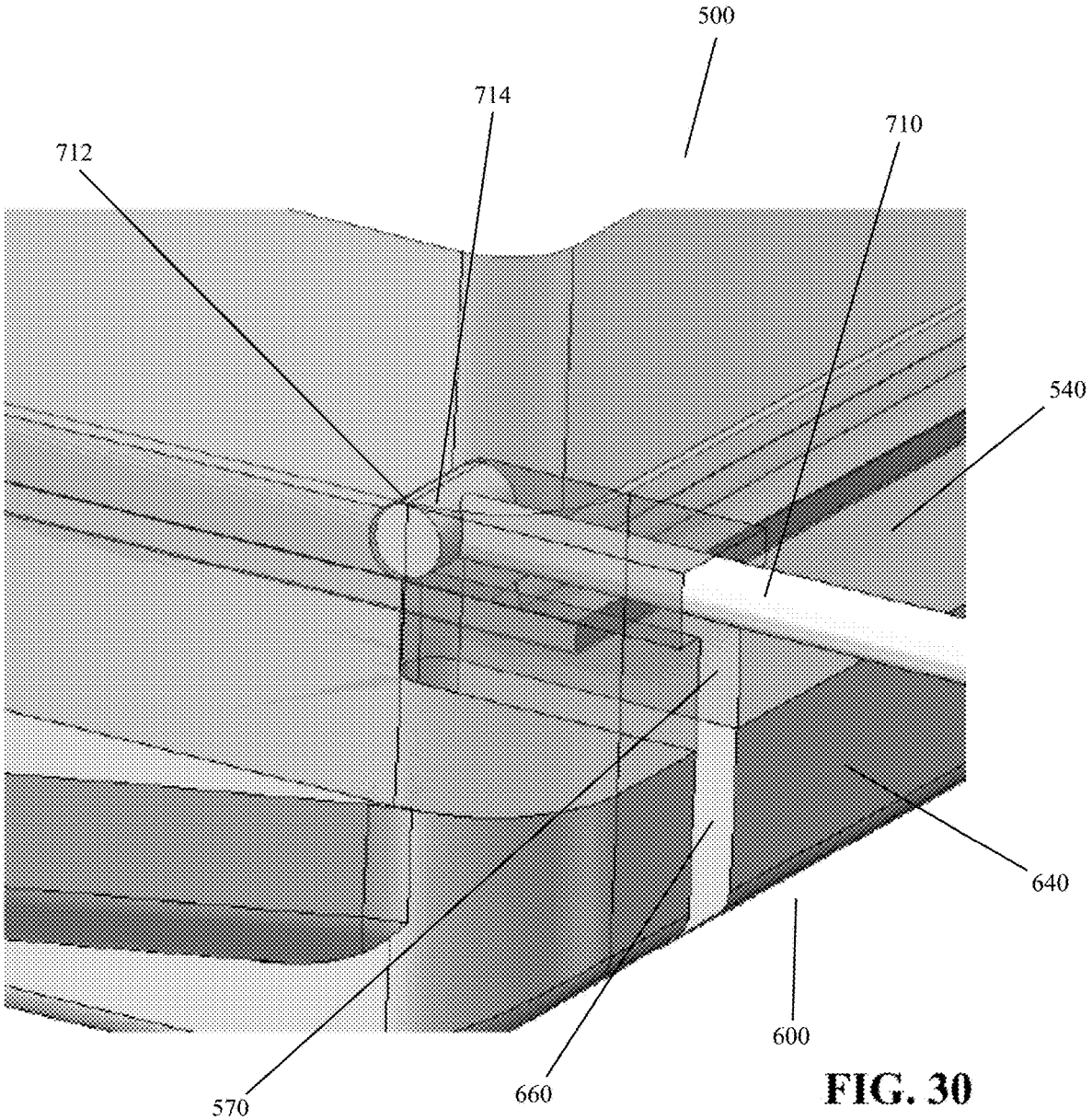
FIG. 30 is a partial perspective view of an edge of the third preferred embodiment of the martial arts training apparatus of the present invention with some portions transparent to illustrate how the handles are mounted to the first mat (the handle being in the unlocked position)
Figure 31:
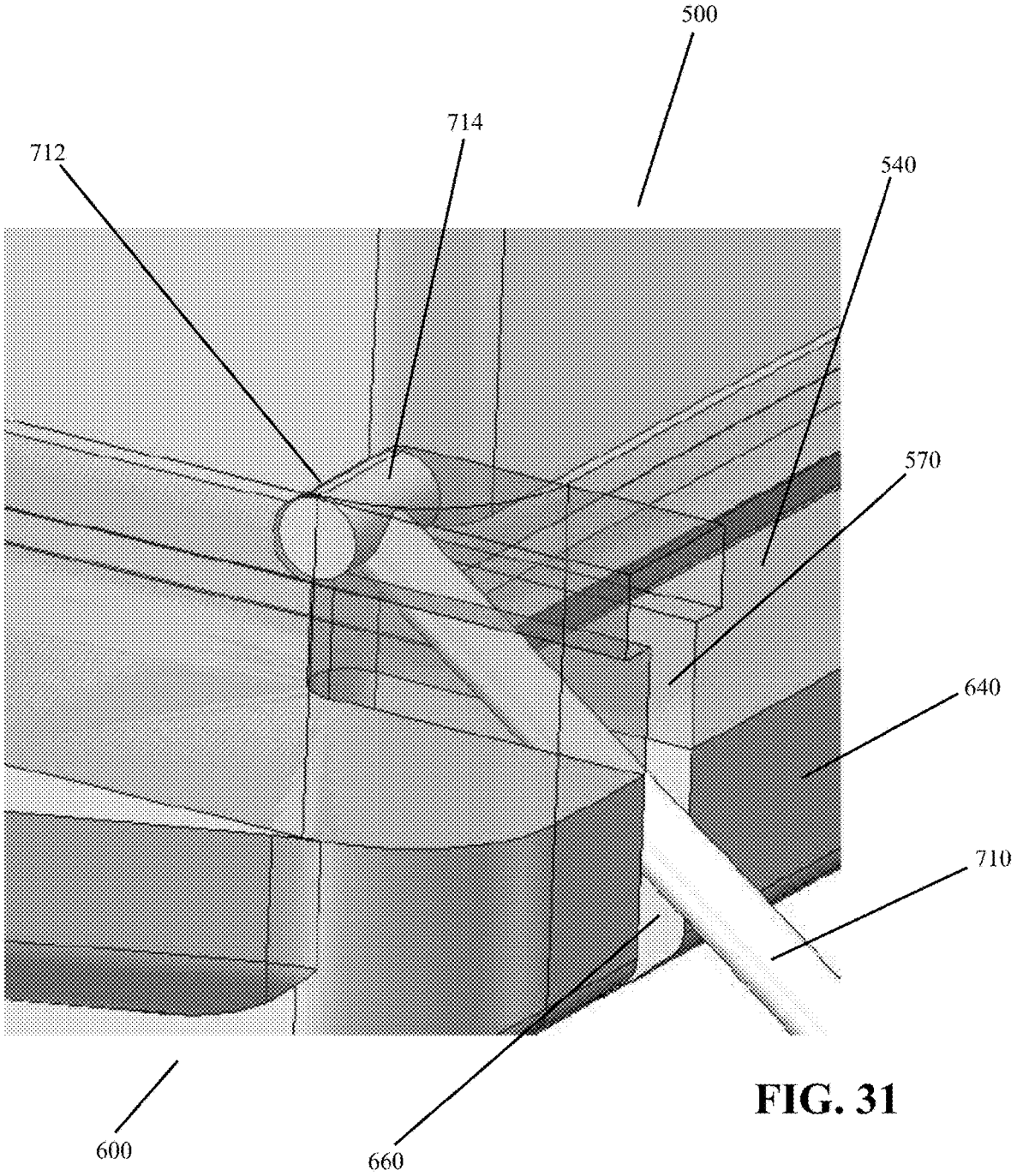
FIG. 31 is a partial perspective view of an edge of the third preferred embodiment of the martial arts training apparatus of the present invention with some portions transparent to illustrate how the handles are mounted to the first mat (the handle being slightly rotated towards the locked position)
Figure 32:
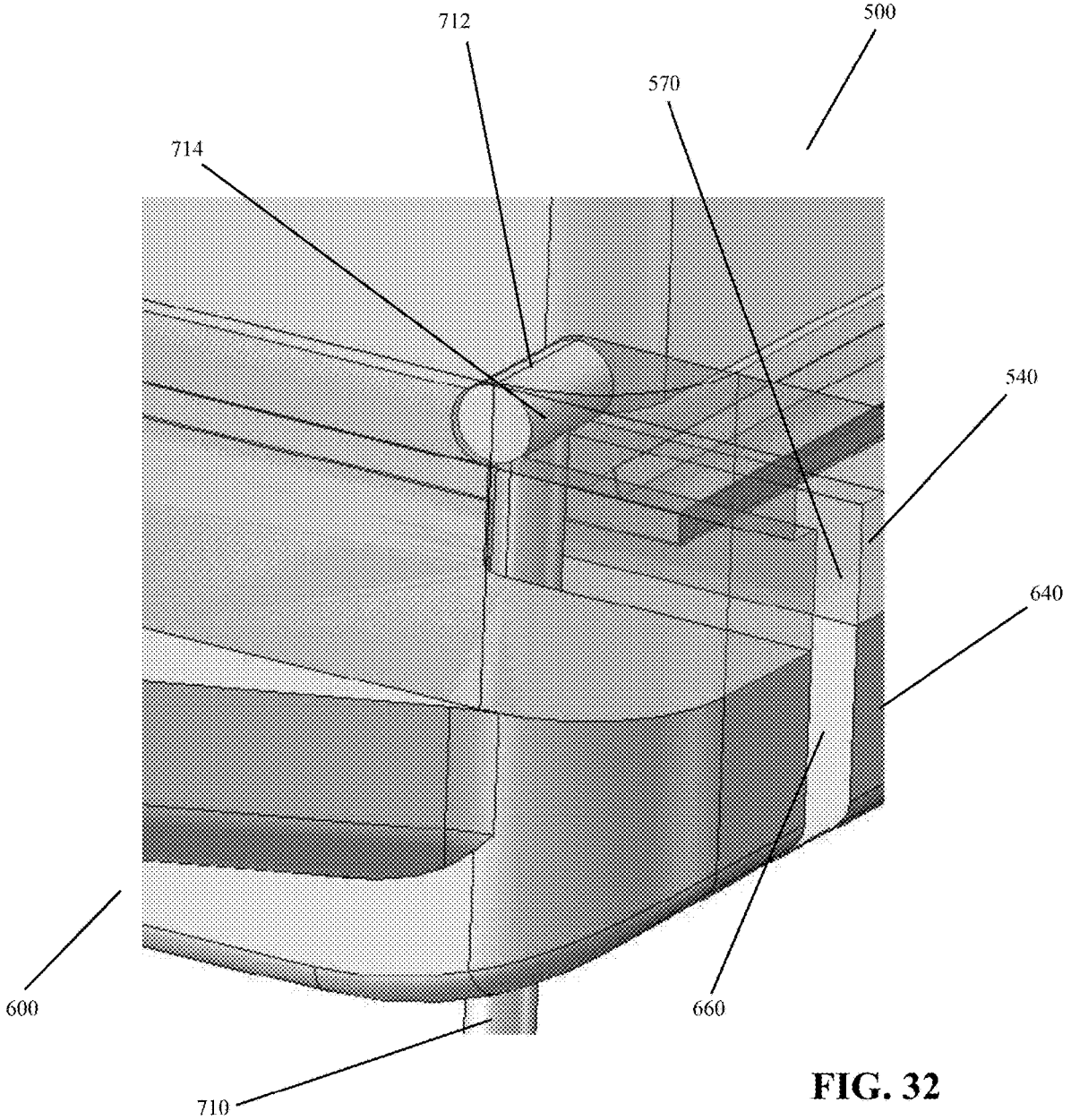
FIG. 32 is a partial perspective view of an edge of the third preferred embodiment of the martial arts training apparatus of the present invention with some portions transparent to illustrate how the handles are mounted to the first mat (the handle being in the locked position).

The second mat also has channels 660 defined on opposite side members 640 that align with the barrel channels 570 formed in the first mat, so that the handles 700 may be pivoted to the locked position, with the handles 700 on the outside of the second mat 600 when the first and second mats are mounted together, as progressively shown in FIGS. 23-25. The first and second mats are locked together as shown in FIG. 25.

Other configurations for aligning the first and second mats are anticipated by the present invention. For instance, the alignment pegs may be carried on the second mat and the first mat may have the corresponding alignment bores for receiving the alignment pegs.

Also formed on the back side 630 of second mat 600 are handle recesses 670. When the handles are rotated to the locked position, handle lateral extensions 750 will nest within the handle recesses 670 to lock the first and second mats together.

To use the present invention, the first and second mat members are separated, as shown in FIG. 21. A target is loaded onto the paper tray (recess) 560 formed on the back side of the first mat. The second mat is the positioned on top of the first mat, with the front side 620 of the second mat 600 in contact with the edges of the target and the back side 530 of the first mat 500.

Alignment pegs of the first mat 500 extended into the alignment bores 650 of the second mat 600. The handles 700 are rotated to the locked position as shown in FIG. 25. The handles 700 are then used to hold the martial arts training device so that a martial arts participant can strike the target. If the target is struck and damaged or destroyed, the martial arts training device can be quickly disassembled, the target replaced and the martial arts training device re-assembled into its locked position for continued use.

Figure 11:
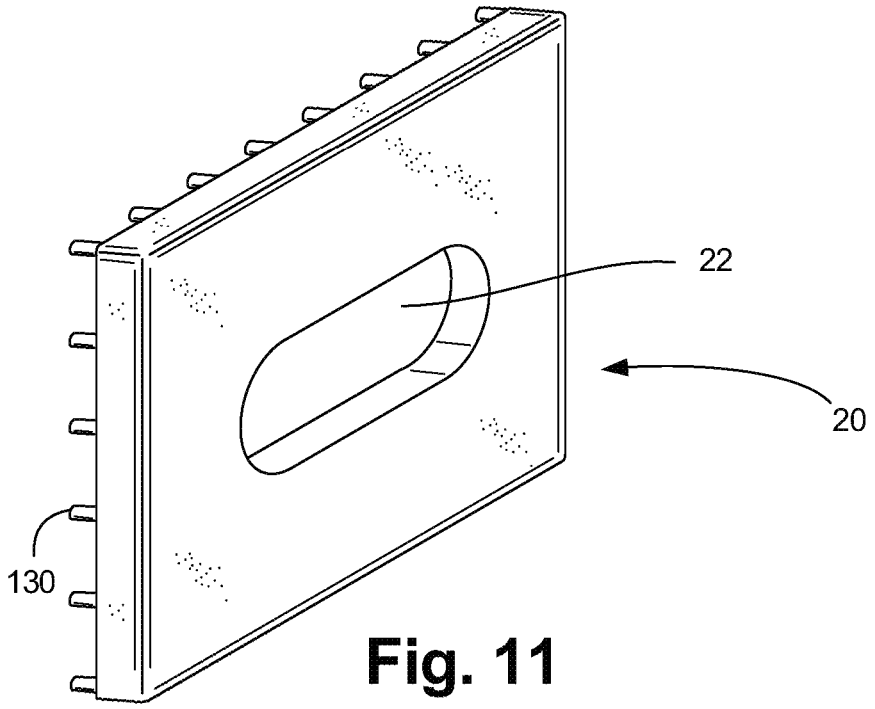
FIG. 11 is a perspective view of a supplemental mat having an opening with a non-circular shape.

As with other embodiments described supra, the third embodiment may be equipped with pegs or bores to accommodate the addition of a supplemental third mat, as shown in FIGS. 10, 10A and 11. (Many third mats having different opening sizes may be utilized to obtain the desired opening size.) It is anticipated that the third mat may be secured to the first mat by other means known in the art, such as a hinge, slide tracks, etc.

The target may be of any desired color, texture or strength and have drawings or pictures on it to help martial arts participants focus on hitting the target, or simply for entertainment or novelty.

In another embodiment, a pair of grooves or other marks can be defined in the back side of the first mat to mark the edges of where targets are to be mounted within the training device.

The sound mechanism, light mechanism, scroll, "fail" button and other features described supra can also be added to the third embodiment.

The invention claimed is:

1. A martial arts training apparatus comprising:

a. a first mat having a first side, an opposite second side, an opening there through;

b. a second mat having an opening there through, the second mat being aligned in mating relation with the first mat, with the respective openings of the first and second mats aligned, to secure a target between the first and second mats in alignment with the mat openings;

c. a first handle pivotally secured to the first side of the first mat, the first handle having a lateral extension for engaging the second mat and securing the second mat in locking relation with the first mat;

d. a second handle pivotally secured to the second side of the first mat, the second handle having a lateral extension for engaging the second mat and securing the second mat in locking relation with the first mat;

e. wherein each handle rotates between an unlocked position, extending generally laterally from its respective side of the first mat, and a locked position, rotated to extend substantially perpendicular to the front plane of the first mat with the handle lateral extensions in contact with the second mat.

2. The martial arts training apparatus of claim 1 wherein the second mat includes recesses that mate with the lateral extensions when the handles are rotated to the locked position.

3. The martial arts training apparatus of claim 1 wherein the handles are pivotally secured to the first mat by a bolt and barrel assembly extending from the handle into rotatable engagement with a T-shaped channel defined on each of the first and second sides of the first mat.

4. The martial arts training apparatus of claim 1 wherein the handles are pivotally secured to the first mat by a bolt and barrel assembly extending from the handle into rotatable engagement with a T-shaped channel defined on each of first and second sides of the first mat, and the second mat includes channels that align with the T-shaped channels formed in the first mat, so that the bolts will pass through the channels of the first and second mats when the handles are rotated to the locked position.

5. The martial arts training apparatus of claim 1 wherein the first and second mats include corresponding alignment pegs and bores to align the first and second mats.

6. The martial arts training apparatus of claim 1 wherein the mats are composed of multi-density foam.

7. The martial arts training apparatus of claim 1 wherein the mats have an exterior surface covered by non-slip vinyl.

8. The martial arts training apparatus of claim 1 wherein the first mat has a strike surface, and further including a supplemental mat having an opening of different size and/or configuration than the opening in the first mat and means for securing the supplemental mat to the strike surface of the first mat.

9. The martial arts training apparatus of claim 1 wherein the first mat includes a number of recesses on a front side of the first mat for engaging pegs, and further including a supplemental mat having an opening of different size or configuration than the opening in the first mat and pegs corresponding to the recesses of the first mat extending from a back side of the supplemental mat, for mounting the supplemental mat to the front of the first mat.

10. The martial arts training apparatus of claim 1 further comprising a sound mechanism for emitting one or more of: a) a first sound when the target is properly struck; or b) a second sound when the target is not properly struck.

11. The martial arts training apparatus of claim 1 further comprising a light mechanism for emitting one or more of: a) a first light when the target is properly struck; b) a second light when the target is not properly struck.

12. The martial arts training apparatus of claim 1 further comprising a sound or light device that is configured to be manually triggered.

* * * * *